US008459219B2

(12) United States Patent
Fukami et al.

(10) Patent No.: US 8,459,219 B2
(45) Date of Patent: Jun. 11, 2013

(54) VARIABLE VALVE DEVICE

(75) Inventors: Toru Fukami, Kawasaki (JP); Tsuyoshi Arinaga, Yamato (JP); Shinichi Takemura, Fujisawa (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 480 days.

(21) Appl. No.: 12/672,801

(22) PCT Filed: Aug. 8, 2008

(86) PCT No.: PCT/JP2008/064609

§ 371 (c)(1),
(2), (4) Date: Feb. 9, 2010

(87) PCT Pub. No.: WO2009/022729

PCT Pub. Date: Feb. 19, 2009

(65) Prior Publication Data

US 2011/0265748 A1 Nov. 3, 2011

(30) Foreign Application Priority Data

| | | |
|---|---|---|
| Aug. 10, 2007 | (JP) | 2007-209706 |
| Aug. 21, 2007 | (JP) | 2007-214529 |
| Feb. 25, 2008 | (JP) | 2008-043126 |
| Feb. 28, 2008 | (JP) | 2008-047918 |

(51) Int. Cl.
*F01L 1/34* (2006.01)

(52) U.S. Cl.
USPC ..... 123/90.16; 123/90.15; 123/90.39; 74/559

(58) Field of Classification Search
USPC ..... 123/90.15, 90.16, 90.39; 74/559, 74/569
See application file for complete search history.

(56) References Cited

U.S. PATENT DOCUMENTS

| | | | |
|---|---|---|---|
| 5,937,809 | A | 8/1999 | Pierik et al. |
| 6,019,076 | A | 2/2000 | Pierik et al. |

(Continued)

FOREIGN PATENT DOCUMENTS

| | | | |
|---|---|---|---|
| CN | 1657746 | A | 8/2005 |
| DE | 10109234 | A1 | 9/2001 |

(Continued)

OTHER PUBLICATIONS

Shinichi Takemura et al., USPTO Non-Final Office Action, U.S. Appl. No. 12/672,809, filed Mar. 15, 2012, 13 pgs.

(Continued)

*Primary Examiner* — Zelalem Eshete
(74) *Attorney, Agent, or Firm* — Foley & Lardner LLP

(57) ABSTRACT

A variable valve device includes: a drive shaft (1) that rotates in synchronization with a crankshaft of an engine; a drive cam (13) provided on the drive shaft (1); a rocker cam (6) pivotally supported on the drive shaft (1); an engine valve that is driven to open and close by the rocker cam (6); a rocker shaft (7) disposed parallel to the drive shaft (1); a rocker arm (3) pivotally supported on the rocker shaft (7); a first link (4) that links the rocker arm (3) and the drive cam (13); a second link (5) that links the rocker arm (3) and the rocker cam (6); and a rocker shaft position modifying means (27) for modifying an operating angle and a lift of the engine valve by varying a position of the rocker shaft (7) relative to the drive shaft (1), wherein the position of the rocker shaft (7) relative to the drive shaft (1) is modified such that within a predetermined operating angle range of the engine valve, a variation of a maximum lift of the engine valve accompanying control of the operating angle is suppressed in comparison with a case in which the operating angle is modified outside of the predetermined operating angle range.

16 Claims, 23 Drawing Sheets

U.S. PATENT DOCUMENTS

| | | | |
|---|---|---|---|
| 6,041,746 | A | 3/2000 | Takemura et al. |
| 6,390,035 | B2 | 5/2002 | Moteki et al. |
| 6,561,148 | B2 | 5/2003 | Moteki et al. |
| 6,694,935 | B2 | 2/2004 | Miyazato et al. |
| 7,152,560 | B2 | 12/2006 | Miyanoo et al. |
| 7,246,578 | B2 | 7/2007 | Nakamura et al. |
| 7,748,356 | B2 | 7/2010 | Meyer et al. |
| 2001/0027762 | A1 | 10/2001 | Moteki et al. |
| 2002/0007809 | A1 | 1/2002 | Miyazato et al. |
| 2002/0108592 | A1 | 8/2002 | Takemura et al. |
| 2005/0178350 | A1 | 8/2005 | Nakamura et al. |

FOREIGN PATENT DOCUMENTS

| | | | |
|---|---|---|---|
| EP | 1026370 | A2 | 8/2000 |
| EP | 1236870 | A2 | 9/2002 |
| EP | 1258601 | A2 | 11/2002 |
| JP | 11-324625 | A | 11/1999 |
| JP | 2001-55915 | A | 2/2001 |
| JP | 2001-227367 | A | 8/2001 |
| JP | 2001-329871 | A | 11/2001 |
| JP | 2002-38913 | A | 2/2002 |
| JP | 2002-89341 | A | 3/2002 |
| JP | 2002-256905 | A | 9/2002 |
| JP | 2003-90235 | A | 3/2003 |
| JP | 2003-343224 | A | 12/2003 |
| JP | 2004-60635 | A | 2/2004 |
| JP | 2005-113720 | A | 4/2005 |
| JP | 2005-291007 | A | 10/2005 |
| JP | 2006-37812 | A | 2/2006 |
| JP | 2006-329022 | A | 12/2006 |
| JP | 2006-329023 | A | 12/2006 |
| JP | 2007-009705 | A | 1/2007 |
| JP | 2007-162706 | A | 6/2007 |
| JP | 2007-231909 | A | 9/2007 |
| JP | 2007-332943 | A | 12/2007 |

OTHER PUBLICATIONS

U.S. Appl. No. 12/672,809, filed Feb. 9, 2010, Takemura et al.

Shinichi Takemura et al., USPTO Non-Final Office Action, U.S. Appl. No. 12/672,809, filed Jul. 30, 2012, (8 pgs.).

Shinichi Takemura et al., Final Office Action, U.S. Appl. No. 12/672,809, dated Nov. 16, 2012, (9 pgs.).

Shinichi Takemura et al., Notice of Allowance, U.S. Appl. No. 12/672,809, dated Apr. 22, 2013, (8 pgs.).

VARIABLE VALVE DEVICE

TECHNICAL FIELD

This invention relates to a variable valve device capable of controlling a lift and an operating angle variably and continuously.

BACKGROUND ART

As a variable valve device capable of controlling a lift or an operating angle of an engine valve variably and continuously, JP2002-38913A, published by the Japan Patent Office in 2002, discloses a variable valve device that is capable of controlling a lift and an operating angle of an engine shaft variably and continuously, comprising: a drive shaft that rotates synchronously with an engine and has a drive cam on an outer periphery thereof; a rocker cam that drives the engine valve to open and close; a rocker arm, one end of which is provided on an eccentric control cam to be free to rock via a first rotation fulcrum (P1) and which is linked to the drive cam and the rocker cam to be free to rotate via second and third rotation fulcrums (P2, P3), respectively, so as to transmit a driving force of the drive cam to the rocker cam through a rocking action; a link arm that links the drive cam to the rocker arm; a link rod that links the rocker cam to the rocker arm; and a control shaft that controls rotation of the eccentric control cam using an actuator, wherein the second and third rotation fulcrums (P2, P3) exist in an identical direction relative to a line linking the first rotation fulcrum (P1) to a rotation center (X) of the drive shaft.

However, in the variable valve device described above, when the operating angle of the engine valve is modified, the position of a rocker shaft is moved without taking into account lift variation in the engine valve accompanying angular variation in a straight line (an imaginary straight line of a fixed length) linking the drive shaft center (X) and the rocker shaft center (P1) and lift variation in the engine valve accompanying variation in a distance (an imaginary distance at a fixed angle) between the drive shaft center (X) and the rocker shaft center (P1), and therefore the lift of the engine valve relative to its operating angle does not take a desired value. From a state of minimum lift control to a state of maximum lift control, angular variation in the straight line linking the drive shaft center to the rocker shaft center acts in a direction for increasing the lift of the engine valve, while the distance between the drive shaft center and the rocker shaft center increases to a midway point (from a minimum operating angle to an intermediate operating angle) so as to act in the direction for increasing the lift and then (from the intermediate operating angle to a maximum operating angle) decreases so as to act in a direction for reducing the lift. At this time, in the variable valve device described above, an offset of the rocker shaft center (the offset of the rocker shaft center P1 relative to an axial center P) is inappropriate, giving rise to an undesirable operating angle variation range in which the operating angle increases but the lift decreases greatly. More specifically, the offset of the rocker shaft center is extremely small, and therefore angular variation in the straight line linking the drive shaft center to the rocker shaft center becomes excessively small, causing the action that increases the lift of the engine valve, which is produced by angular variation in the straight line linking the drive shaft center to the rocker shaft center, to become extremely small. As a result, the action that reduces the lift of the engine valve, which is produced by variation in the distance between the drive shaft center and the rocker shaft center, cannot be overridden from the intermediate operating angle to the maximum operating angle, and therefore the lift decreases greatly while the operating angle increases.

DISCLOSURE OF THE INVENTION

It is an object of this invention to provide a variable valve device with which a reduction in a lift of a rocker cam can be suppressed within a predetermined operating angle range.

To achieve the above object, this invention is a variable valve device including: a drive shaft that rotates in synchronization with a crankshaft of an engine; a drive cam provided on the drive shaft; a rocker cam pivotally supported on the drive shaft; an engine valve that is driven to open and close by the rocker cam; a rocker shaft disposed parallel to the drive shaft; a rocker arm pivotally supported on the rocker shaft; a first link that links the rocker arm and the drive cam; a second link that links the rocker arm and the rocker cam; and a rocker shaft position modifying section that modifies a position of the rocker shaft relative to the drive shaft to control an operating angle and a lift of the engine valve, wherein the position of the rocker shaft relative to the drive shaft is modified such that a variation of a maximum lift of the engine valve accompanying control of the operating angle within a predetermined operating angle range of the engine valve is suppressed as compared to a variation of a maximum lift of the engine valve accompanying control of the operating angle outside of the predetermined operating angle range.

The details as well as other features and advantages of this invention are described in the following description of the specification and illustrated in the attached drawings.

BEST MODES FOR CARRYING OUT THE INVENTION

Figure 1:
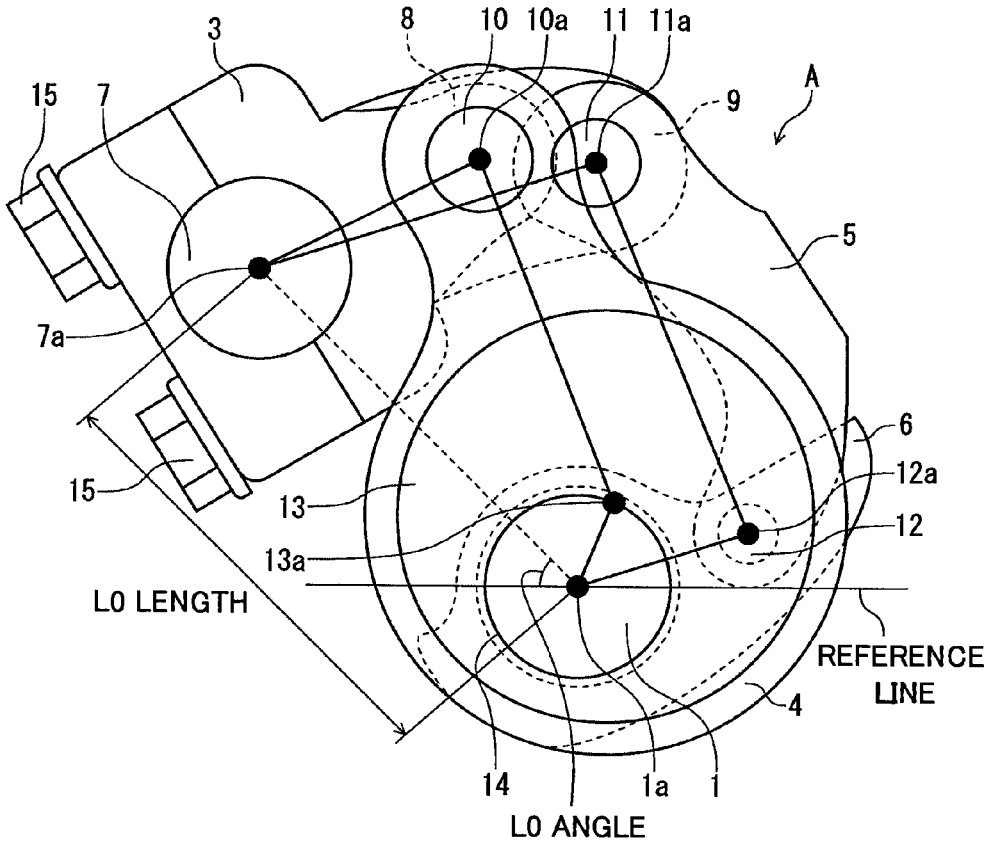
FIG. 1 is a view showing the basic constitution of a variable valve device A to which a first embodiment of this invention is applied.

FIG. 1 is a view showing the basic constitution of a variable valve device A to which an embodiment is applied when an internal combustion engine is seen from a front surface (a crankshaft axis direction).

The variable valve device A is a mechanism that can control a lift and an operating angle of an intake valve variably and continuously. It should be noted that subsequent description relating to lift variation indicates variation of a maximum lift.

A drive shaft 1 is supported to be free to rotate on a cylinder head serving as an engine main body. The drive shaft 1 is driven by a crankshaft of the engine via a timing chain or a timing belt. A rotation direction of the drive shaft corresponds to a clockwise direction in FIG. 1.

The drive shaft 1 comprises a drive cam 13 having a circular outer peripheral surface that is eccentric to a center of the drive shaft 1. The drive cam 13 is formed by fixing a separate disc-shaped component having an eccentric hole to an outer periphery of the drive shaft 1 by press fitting or the like. Further, a pair of rocker cams 6 provided for each cylinder are supported on the drive shaft 1 to be free to rotate (free to rock) relative to the drive shaft 1 in positions deviating in an axial direction from a position in which the drive cam 13 is fixed. When the pair of rocker cams 6 rock (perform a vertical motion) about the drive shaft 1 within a predetermined angle range, the intake valve, which is positioned below a cam nose 6*a* of the rocker cam 6, is pressed such that the intake valve is lifted downward. The pair of rocker cams 6 are integrated with each other via a cylindrical portion covering the outer periphery of the drive shaft 1, and therefore rock in phase.

A variable phase mechanism that varies a phase of the operating angle by varying a phase of the drive shaft relative to the crankshaft is provided on a front end of the drive shaft 1. The variable phase mechanism has a similar constitution to a typical, well-known variable phase mechanism, and includes a sprocket provided on the front end portion of the drive shaft 1 and a phase control actuator that causes the sprocket and the drive shaft 1 to rotate relative to each other within a predetermined angle range. The sprocket rotates synchronously with the crankshaft via a timing chain or a timing belt. The phase control actuator is controlled on the basis of a control signal from a control unit. Through the control of the phase control actuator, the sprocket and the drive shaft 1 are caused to rotate relative to each other, and as a result, a lift center angle is retarded and advanced. In other words, the lift is advanced or retarded without changing a lift characteristic curve. Further, this variation can be obtained continuously. Variable phase mechanisms may have various constitutions, including those employing a hydraulic actuator and those employing an electromagnetic actuator, but in this embodiment, it is assumed that a hydraulic actuator is used.

A variable valve rocker arm 3 is supported on a rocker shaft 7 to be free to rock, and includes a first arm 8 and a second arm 9 that project to an identical side of a straight line linking the center of the drive shaft 1 and a center of the rocker shaft 7. The second arm 9 projects by a larger amount than the first arm 8. Further, the variable valve rocker arm 3 is constituted by two divided members that are fastened to either side of the rocker shaft 7 by bolts 15.

A base circle surface forming an arc that is concentric with the drive shaft 1 and a cam surface that extends from the base circle surface in a predetermined curve to form the outer shape of the cam nose 6*a* are formed continuously on a lower surface of the rocker cam 6, and in accordance with a rocking position of the rocker cam 6, the base circle surface and cam surface come into contact with the intake valve or a valve lifter. In other words, the base circle surface serves as a base circle section in which the lift is zero, while a section in which the cam surface contacts the valve lifter in accordance with the rocking motion of the rocker cam 6 serves as a lift section in which the intake valve gradually lifts. A small ramp section is provided between the base circle section and the lift section.

A first link 4 is formed such that one end thereof is fitted rotatably to the drive cam 13 and the other end is connected to the vicinity of a tip end of the first arm 8 via a connecting pin 10.

A second link 5 is formed such that one end thereof is connected to the vicinity of a tip end of the second arm 9 via a connecting pin 11 and the other end is connected to the vicinity of an end portion of the cam nose 6*a* of the rocker cam 6 via a connecting pin 12. The connecting pin 10 serves as a first connection point between the rocker arm 3 and the first link 4, and the connecting pin 11 serves as a second connection point between the rocker arm 3 and the second link 5. The first connection point and second connection point are located on the same side of the straight line linking the center of the drive shaft 1 and the center of the rocker shaft 7. The second connection point (the connecting pin 12) is positioned farther from the center of the rocker shaft 7 than the first connection point (the connecting pin 10). Further, the cam nose 6*a* of the rocker cam 6 is provided on the same side of the straight line linking the center of the drive shaft 1 and the center of the rocker shaft 7 as the first connection point and second connection point such that the drive shaft rotates in an identical orientation to a rotation direction of the rocker cam when the engine valve is opened.

In the variable valve device A constituted as described above, when the drive shaft 1 rotates in synchronization with rotation of the crankshaft of the engine, the first link 4 is caused to move vertically by an action of the drive cam 13, and accordingly, the variable valve rocker arm 3 rocks about the rocker shaft 7. The rocking motion of the variable valve rocker arm 3 is transmitted to the rocker cam 6 via the second link 5, causing the rocker cam 6 to rock. The cam action of the rocker cam 6 causes the intake valve to perform an opening/closing operation.

Figure 2:
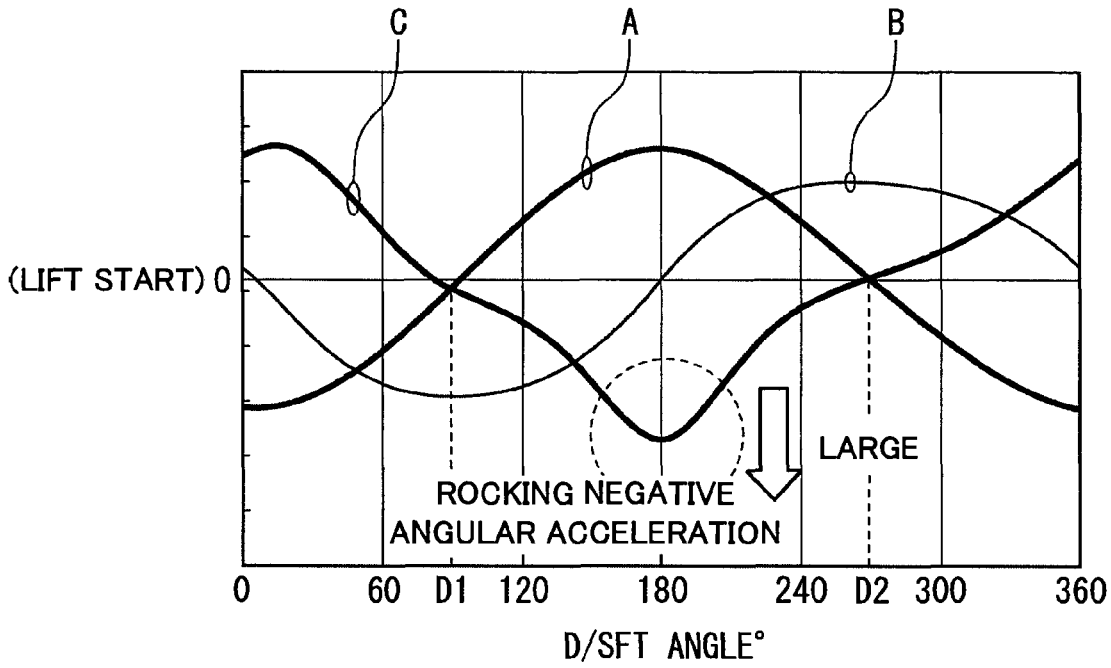
FIG. 2 is a view illustrating a rocking angle, a rocking angular velocity, and a rocking angular acceleration of the variable valve device A.

FIG. 2 is a view illustrating a rocking angle, a rocking angular velocity, and a rocking angular acceleration of the rocker cam 6. A solid line A, a solid line B and a solid line C in FIG. 2 denote characteristics of the rocking angle, the rocking angular velocity and the rocking angular acceleration relative to a drive shaft rotation angle, respectively. It should be noted that in FIG. 2, the drive shaft rotation angle at the maximum lift is set at 180 degrees.

A rocking angle θ (solid line A) of the rocker cam 6 is set at zero degrees at the start of valve lift, and in a direction in which the valve lift increases, or in other words the clockwise direction in FIG. 1, the rocking angle θ is positive. A maximum rocking angle increases as the maximum lift of the valve increases. The rocking angular velocity and the rocking angular acceleration can be expressed as $d\theta/dx$ and $d^2\theta/dx^2$ (where x is the drive shaft rotation angle), respectively. A rocking angular acceleration in a negative direction (an orientation in which the lift of the intake valve decreases) will be referred to as rocking negative angular acceleration, and a case in which an absolute value of negative direction rocking angular acceleration is large will be referred to as "the rocking negative angular acceleration is large".

A single period of the rocking angle θ corresponds to 360 degrees in terms of the drive shaft rotation angle, and the rocking angle θ increases from drive shaft rotation angle zero degrees to 180 degrees and decreases from drive shaft rotation angle 180 degrees to 360 degrees. When the rocking angle θ reaches a maximum value, the intake valve reaches a maximum lift, and a section in which the rocking angle θ takes a positive value (drive shaft rotation angle D1 to D2) serves as the valve lift section. A phase of the rocking angular velocity deviates from the rocking angle θ by substantially 90 degrees so as to reach zero when the rocking angle θ is at the maximum value. The rocking angular acceleration reaches a minimum, or in other words a maximum rocking negative angular acceleration, when the rocking angle is at the maximum value.

In the variable valve device A constituted as described above, varying the operating angle may be considered identical to varying an initial rocking angle of the rocker cam 6. Here, the initial rocking angle denotes the rocking angle when the drive shaft rotation angle is at zero in FIG. 2 (a negative angle indicating the degree to which the rocker cam 6 has rocked to a negative side of zero degrees (the rocking angle at the start of valve lift)).

For example, when the operating angle (lift) is to be reduced, the initial rocking angle is reduced (shifted far to the negative side from the reference lift start rocking angle (zero)). Thus, when the rocker cam 6 rocks in accordance with rotation of the drive shaft 1, the base circle surface remains in contact with the valve lifter for a long time, thereby shortening the period of contact between the cam surface and the valve lifter. This leads to an overall reduction in the lift and a reduction in the operating angle.

When the operating angle (lift) is to be increased, on the other hand, the initial rocking angle is increased (prevented from shifting far to the negative side from the reference lift start rocking angle (zero)). In this case, in contrast to a case in which the operating angle (lift) is reduced, the period of contact between the base circle surface and the valve lifter is shortened, leading to lengthening of the period of contact between the cam surface and valve lifter, and as a result, the lift increases and the operating angle increases.

To vary the initial rocking angle in this manner, the angle of the rocker cam 6 relative to the valve lifter when compared at a constant drive shaft rotation angle (when the angle of the drive cam is constant) must be varied, and for this purpose, the position of the rocker shaft 7 is varied.

Two basic methods of varying the position of the rocker shaft 7 exist. In one method, a distance (to be referred to hereafter as an "L0 length") between the center of the drive shaft 1 and the center of the rocker shaft 7 is varied, and in the other method, the angle of the line linking the center of the drive shaft 1 and the center of the rocker shaft 7 is varied (the entire device is tilted), or in other words, an angle (to be referred to hereafter as an "L0 angle") formed by an arbitrary reference line passing through the center of the drive shaft 1 in FIG. 1 and the straight line linking the center of the drive shaft 1 and the center of the rocker shaft 7 is varied.

For example, when the L0 length is increased (without varying the L0 angle) in FIG. 1, a center 7*a* of the rocker shaft 7 is positioned further above a center 1*a* of the drive shaft 1 than when the L0 length is short. At this time, the position of the center la of the drive shaft 1 is constant and the position of a center 13*a* of the drive cam 13 remains the same (i.e. the rotation angle of the drive shaft remains unchanged). Further, a length between the center 7*a* of the control shaft 7 and the first connection point 10*a* and a length between the first connection point 10*a* and the center 13*a* of the drive cam 13 are constant, and therefore an angle formed by a line linking the control shaft center 7*a* to the first connection point 10*a* and a line linking the first connection point 10*a* to the drive cam center 13*a* increases when the L0 length is increased. Hence, when the L0 length is increased, the line linking the control shaft center 7*a* and the first connection point 10*a* varies at a similar incline to the incline during clockwise direction rotation. At this time, the second connection point 11*a*, which is further removed from the rocker shaft center 7*a* than the first connection point 10*a*, moves downward in the figure in accordance the principle of leverage (i.e. due to the fact that the control shaft center 7*a* moves upward when the position of the first connection point 10*a* does not vary greatly). As a result, the entire second link is pushed downward such that a center 12*a* of the connecting pin 12 connecting the second link 5 and the rocker cam 6 is pushed relatively downward, and therefore the initial rocking angle increases (the degree of negativity thereof decreases), leading to an increase in the operating angle (lift). Conversely, when the L0 length decreases, the initial rocking angle decreases (the degree of negativity thereof increases), leading to a reduction in the operating angle (lift).

Meanwhile, when the L0 angle is increased (in a state where the L0 length remains unchanged), the variable valve rocker arm 3, the first link 4, the second link 5, and the rocker cam 6 rotate in the clockwise direction of FIG. 1 about a rocking axis of the rocker cam 6 while maintaining their relative attitudes, and as a result, the initial rocking angle increases (the degree of negativity thereof decreases), leading to an increase in the operating angle (lift). When the L0 angle is reduced, on the other hand, the initial rocking angle decreases (the degree of negativity thereof increases), leading to a reduction in the operating angle (lift). It should be noted that variation in the "relative attitudes" may be determined by determining whether or not variation has occurred in the shape of a square formed by linking the center 7*a* of the rocker shaft 7, the center 10*a* of the connecting pin 10, the center 1*a* of the drive shaft 1 and the center 13*a* of the drive cam 13 or a square formed by linking the center 7*a* of the rocker shaft 7, the center 11*a* of the connecting pin 11, the center 12*a* of the connecting pin 12 and the center 1*a* of the drive shaft 1 (see FIG. 1).

Figure 3B:
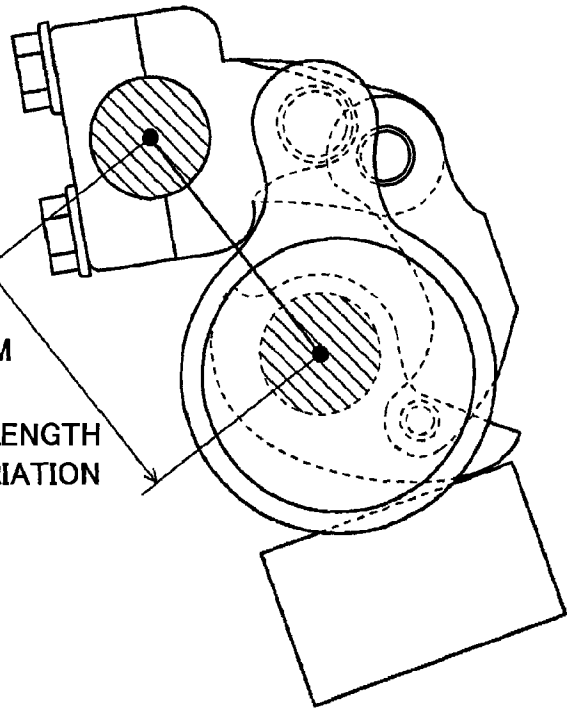
FIG. 3A and FIG. 3B are views showing characteristics of the rocking angle and the rocking angular acceleration when an operating angle is modified by varying an L0 length.
Figure 3A:
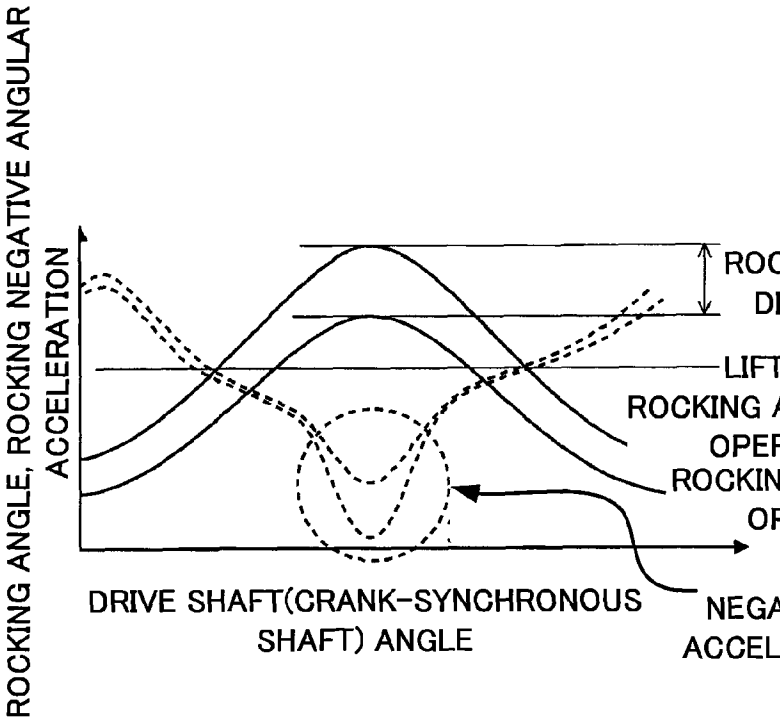
Figure 4B:
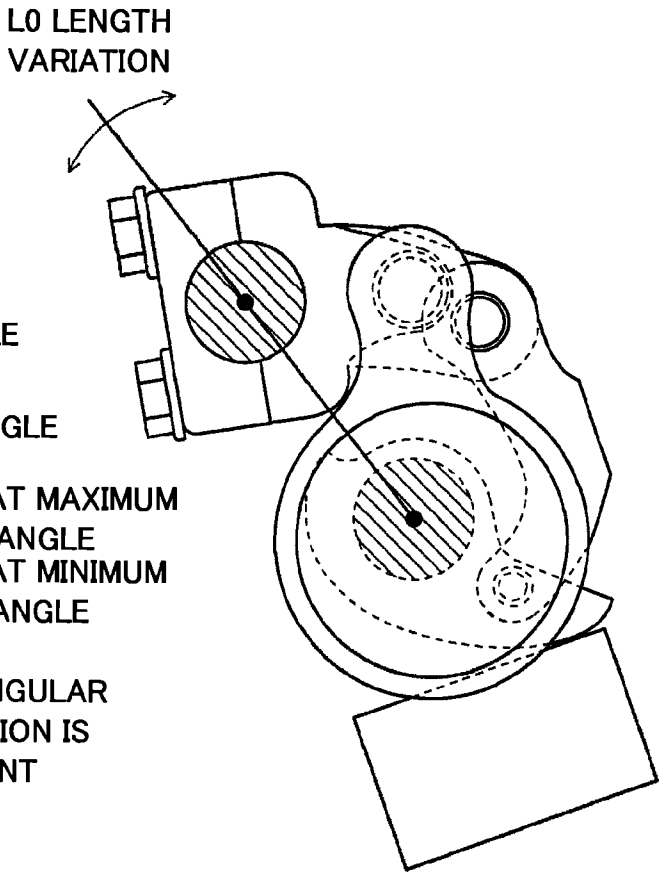
FIG. 4A and FIG. 4B are views showing characteristics of the rocking angle and the rocking angular acceleration when the operating angle is modified by varying an L0 angle.
Figure 4A:
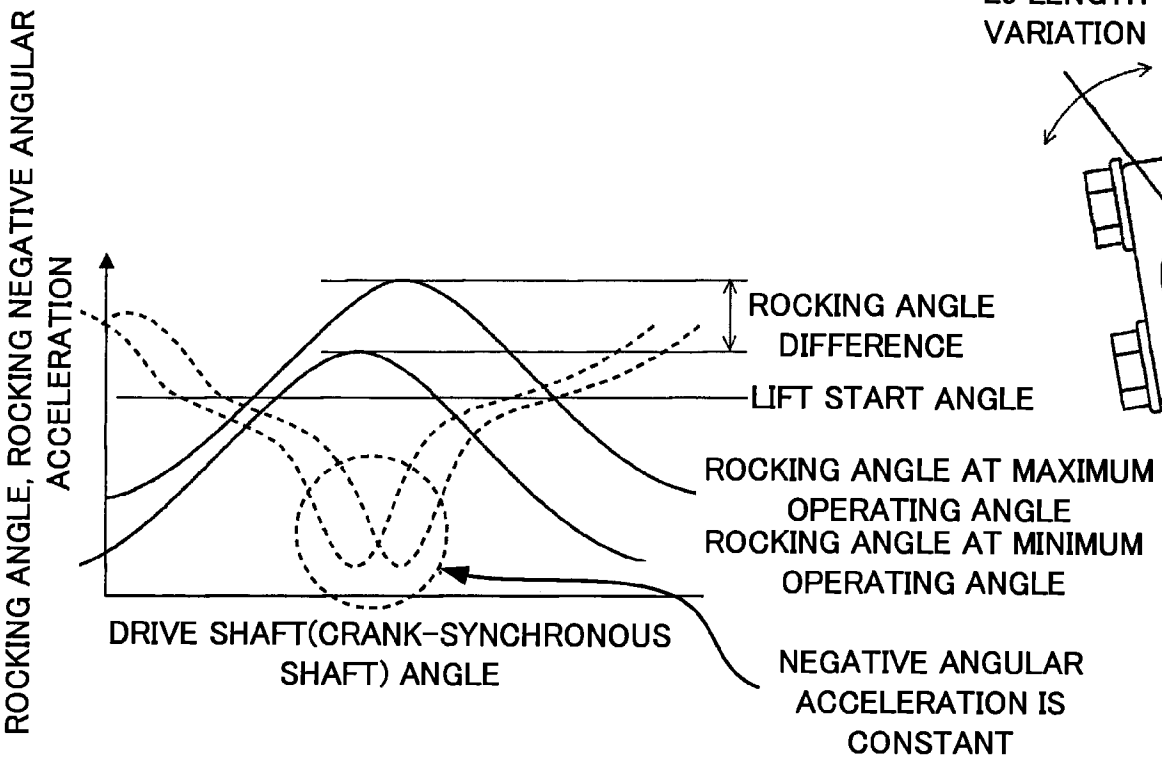

FIGS. 3A and 3B and FIGS. 4A and 4B are views showing characteristics of the rocking angle and rocking angular acceleration of the rocker cam 6 in cases where the operating angle of the intake valve is large and small. FIG. 3A and FIG. 3B show a case in which the operating angle is modified by varying the L0 length, whereas FIG. 4A and FIG. 4B show a case in which the operating angle is modified by varying the L0 angle.

As shown in FIG. 3A and FIG. 3B, when the L0 length is varied, an absolute value (a divergence from acceleration zero) of the rocking negative angular acceleration (the angular acceleration of the rocker cam in an orientation for reducing the lift) at a valve lift peak increases to a greater extent at a large operating angle (at which the rocking negative angular acceleration is indicated by a lower side broken line in the figure) than at a small operating angle (at which the rocking negative angular acceleration is indicated by an upper side broken line in the figure). The reason for this is that when the L0 length varies, the relative attitudes of the variable valve rocker arm 3, first link 4, second link 5 and rocker cam 6 vary, and therefore the rocking angle of the rocker cam 6 per unit rotation angle of the drive shaft 1 varies. In other words, as the L0 length increases, the rocking angle of the rocker cam 6 per unit rotation angle of the drive shaft 1 increases (particularly at a large operating angle in the vicinity of the maximum lift).

As described above, the reason why the absolute value of the rocking negative angular acceleration increases when the operating angle is increased by increasing the L0 length is that the acceleration of the intake valve increases as the operating angle is increased. When the acceleration of the intake valve increases as the operating angle is increased, the valve lift (variation) per unit rotation angle of the drive shaft 1 increases (relatively providing that other conditions do not change), and therefore the valve lift, which increases in accordance with increases in the operating angle, can be increased quickly (i.e. the lift can be increased rapidly). If the valve lift at an intermediate operating angle (a predetermined operating angle between the maximum operating angle and the minimum operating angle) cannot be obtained quickly, a reduction in charging efficiency and an increase in pumping loss may occur, leading to a reduction in engine output. However, these dangers can be eliminated by increasing the L0 length to increase the absolute value of the rocking negative angular acceleration following an increase in the operating angle, whereby the valve lift, which increases in accordance with increases in the operating angle, can be increased quickly.

Meanwhile, when the L0 angle is varied, as shown in FIG. 4A and FIG. 4B, the rocking negative angular acceleration does not vary between a large operating angle and a small operating angle. The reason for this is that when the L0 angle is varied, the relative attitudes of the variable valve rocker arm 3, the first link 4, the second link 5 and rocker cam 6 do not vary, as described above. It should be noted that at a rocking angle and angular acceleration peak, the entire device rotates in accordance with the variation in the L0 angle, and therefore the position of the peak relative to the drive shaft angle is different before and after the variation. When the entire device is tilted in an identical orientation to the rotation direction of the drive shaft, the peak position relative to the drive shaft angle shifts to a retardation side.

Figure 5:
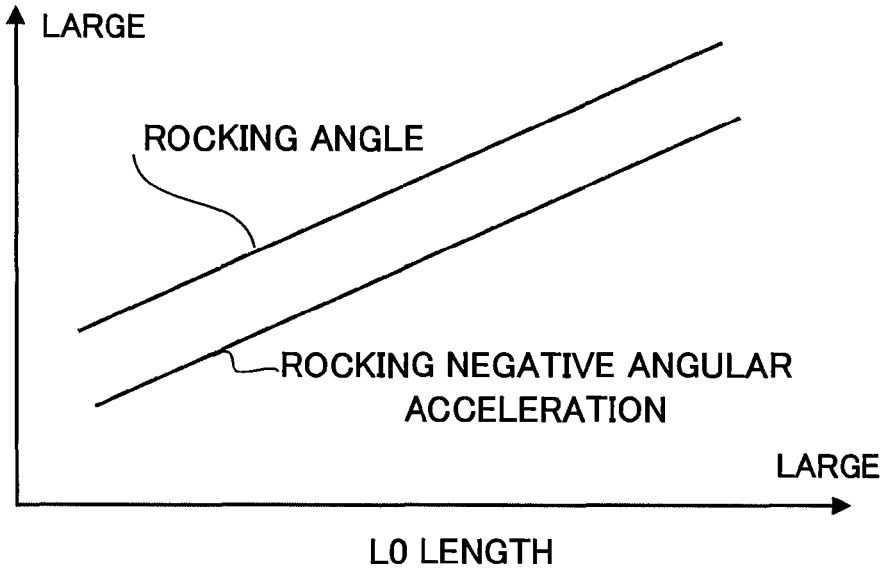
FIG. 5 is a view summarizing a relationship of the L0 length with the rocking angle and a rocking negative angular acceleration.
Figure 6:
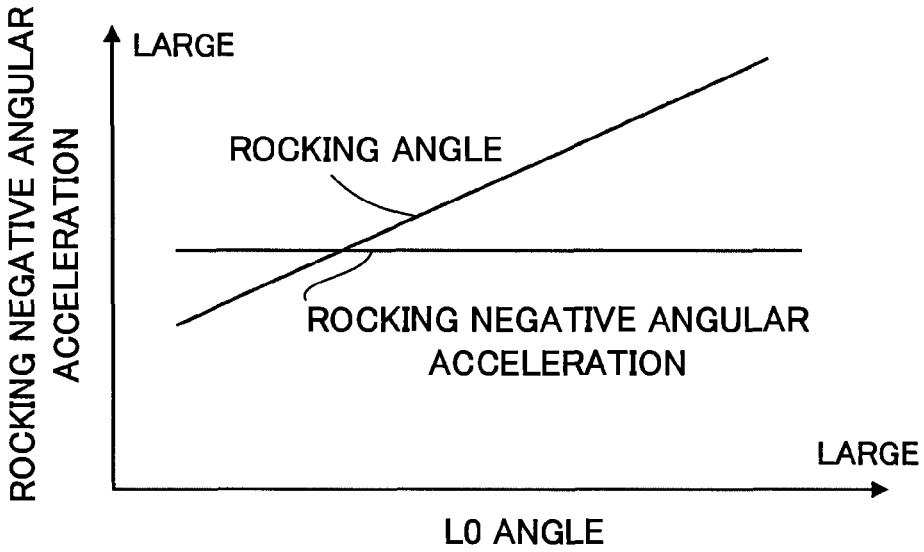
FIG. 6 is a view summarizing a relationship of the L0 angle with the rocking angle and the rocking negative angular acceleration.

FIG. 5 and FIG. 6 are views summarizing a relationship of the L0 length and the L0 angle, respectively, with the rocking angle and the absolute value of the rocking negative angular acceleration.

As shown in FIG. 5, respective maximum values of the rocking angle and the absolute value of the rocking negative angular acceleration increase as the L0 length increases. In other words, as the L0 length increases, the rocking angle of the rocker cam 6 per unit rotation angle of the drive shaft 1 increases (particularly at a large operating angle in the vicinity of the maximum lift). When the L0 angle is increased, on the other hand, the maximum value of the rocking angle increases but the maximum value of the rocking negative angular acceleration remains constant, as shown in FIG. 6.

When the operating angle is increased by increasing the L0 length, the maximum absolute value of the rocking negative angular acceleration increases, and when the acceleration of the intake value increases, the valve lift per unit rotation angle of the drive shaft 1 increases (relatively providing that other conditions do not change), and therefore the valve lift in the vicinity of the predetermined operating angle (an intermediate operating angle) can be increased, thereby preventing a reduction in charging efficiency and an increase in pumping loss and enabling an increase in engine output. However, a rapid increase in the valve lift is desirable only up to the predetermined operating angle (an intermediate operating angle), and if the valve lift increases too quickly in the vicinity of the maximum operating angle, the maximum lift becomes excessively large, leading to increases in mechanical loss (for example, the work required to counteract a valve spring reaction force) and a deterioration in efficiency. Therefore, from the predetermined operating angle (an intermediate operating angle) to the vicinity of the maximum operating angle, the L0 angle is increased while shortening the L0 length, thereby increasing the operating angle of the intake valve while preventing the maximum lift in the vicinity of the maximum operating angle from becoming excessively large, and as a result, problems such as an increase in mechanical loss can be eliminated. To assist understanding, a case in which the operating angle is varied by varying the L0 angle alone without changing the L0 length will now be described in further detail with reference to a specific structure (reference example).

Figure 7:
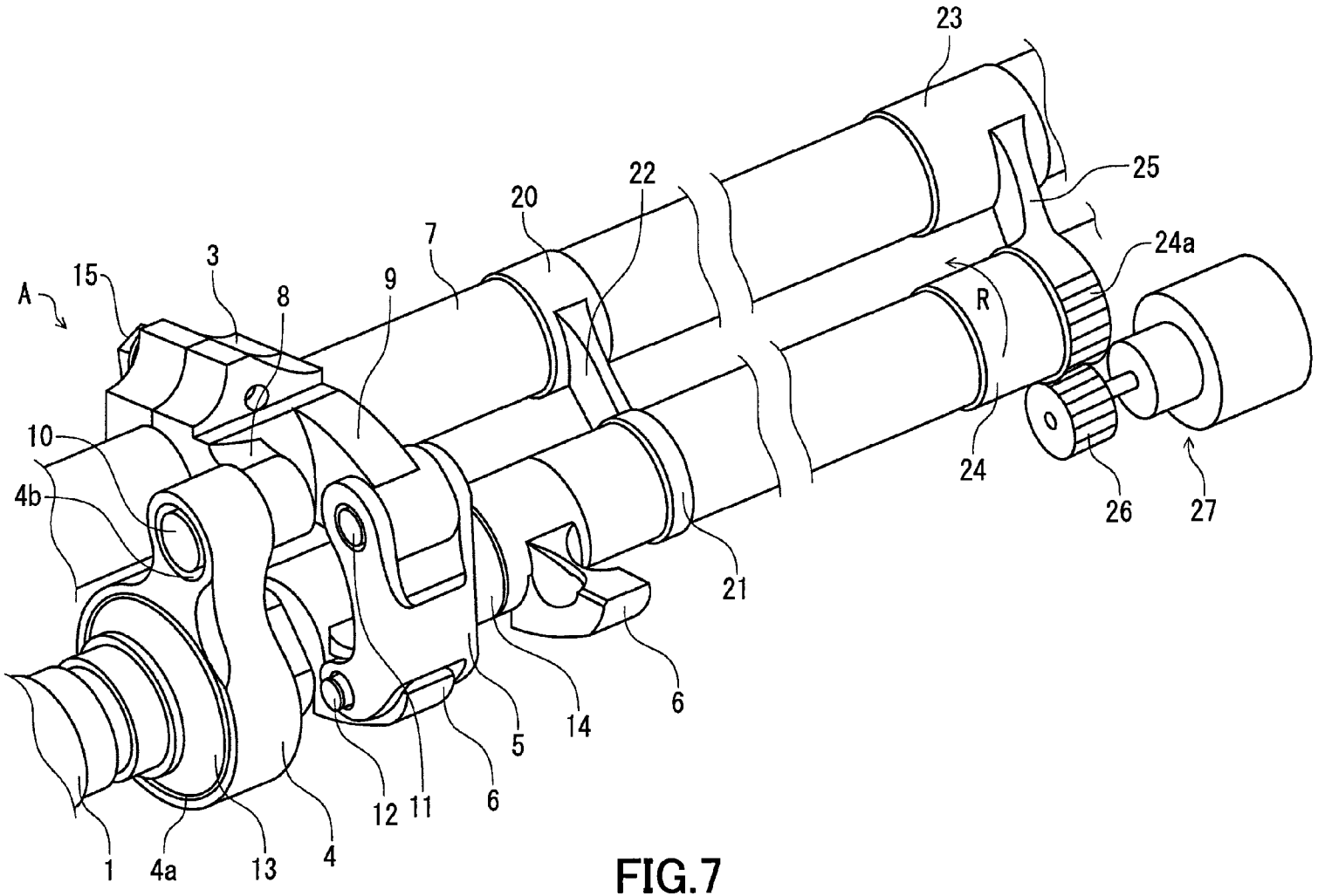
FIG. 7 is an exterior view of the variable valve device A, serving as a reference example.

FIG. 7 is a view showing an example of a constitution for varying the L0 angle alone, which serves as a reference example. The drive shaft 1, first link 4, second link 5, rocker cam 6, and variable valve rocker arm 3 are identical to their counterparts in FIG. 1.

It should be noted that FIG. 7 shows a single cylinder of an engine in which two intake valves are provided for each cylinder. Accordingly, two rocker cams 6 are provided. The second link 5 is connected to the vicinity of the cam nose 6*a* of one of the rocker cams 6 via the connecting pin 12. Here, the reason why the second link 5 is connected to only one of the two rocker cams 6 is that the two rocker cams 6 are connected by a hollow pipe 14 and therefore, when one of the rocker cams 6 rocks, the other rocker cam 6 rocks similarly.

The rocker shaft 7 is disposed substantially parallel to the drive shaft 1 and further toward an engine upper side than the drive shaft 1.

Reference numerals 20 and 21 in FIG. 7 denote link members fitted rotatably to the rocker shaft 7 and the drive shaft 1, respectively. A reference numeral 22 denotes a bridge member connecting the link members 20, 21. The link members 20, 21 and the bridge member 22 are provided in a plurality in a cylinder array direction. Link members 23, 24 and a bridge member 25 are provided similarly on rear ends of the drive shaft 1 and rocker shaft 7 (a rightward direction in FIG. 7). A gear portion 24*a* meshed to a pinion gear of a motor 27 is provided on an outer periphery of the link member 24 on the rear end of the drive shaft 1. The position of the rocker shaft 7 is shifted by an operating angle modification mechanism constituted by the link members 20, 21, 23, 24, the bridge members 23, 25, the motor 27, and so on.

A sensor that detects the rotation angle of the drive shaft 1 and a sensor that detects the rotation angle of the rocker shaft 7 about the drive shaft 1 are provided, and detection values from these sensors are read to a control unit 100. On the basis of detection values from sensors that detect the operating conditions of a vehicle (for example, a crank angle sensor, an accelerator opening sensor, and so on), the control unit 100 calculates a target operating angle of the intake valve and controls driving and stoppage of the motor 27 accordingly.

In the constitution described above, the pinion gear 26 and the gear portion 24*a* are intermeshed, and therefore, when the motor 27 is driven, the ring member 24 rotates about the drive shaft 1. Accordingly, the ring member 23 connected thereto via the bridge member 25 moves on an arc having a distance between a rotary axis of the drive shaft 1 and a lengthwise direction axis of the rocker shaft 7 (i.e. the L0 length) as a radius.

In other words, the L0 angle can be varied while keeping the L0 length constant. It should be noted that the state shown in FIG. 7 corresponds to the maximum operating angle, and the operating angle is reduced by rotating the ring member 24 in a direction indicated by an arrow R in FIG. 7.

With a constitution such as that of the reference example shown in FIG. 7, when the operating angle of the intake valve is to be varied, the L0 angle alone is varied while the L0 length is kept constant, and therefore the rocking negative angular acceleration of the intake valve can be kept constant regardless of the variation in the operating angle.

FIG. 7 shows an example of a constitution in which the L0 angle is varied while the L0 length is kept constant, but another constitution may be employed. For example, when an actuator rod or the like having one end supported rockably on the cylinder head and another end connected to the rocker shaft 7 so as to be capable of rotation and expansion/contraction using one end as an axis is employed, the rocker shaft 7 can be moved along a locus for varying the magnitude of the L0 angle while keeping the L0 length constant by controlling the rotation amount and expansion/contraction amount of the actuator rod.

Next, a first embodiment of this invention will be described.

Figure 8:
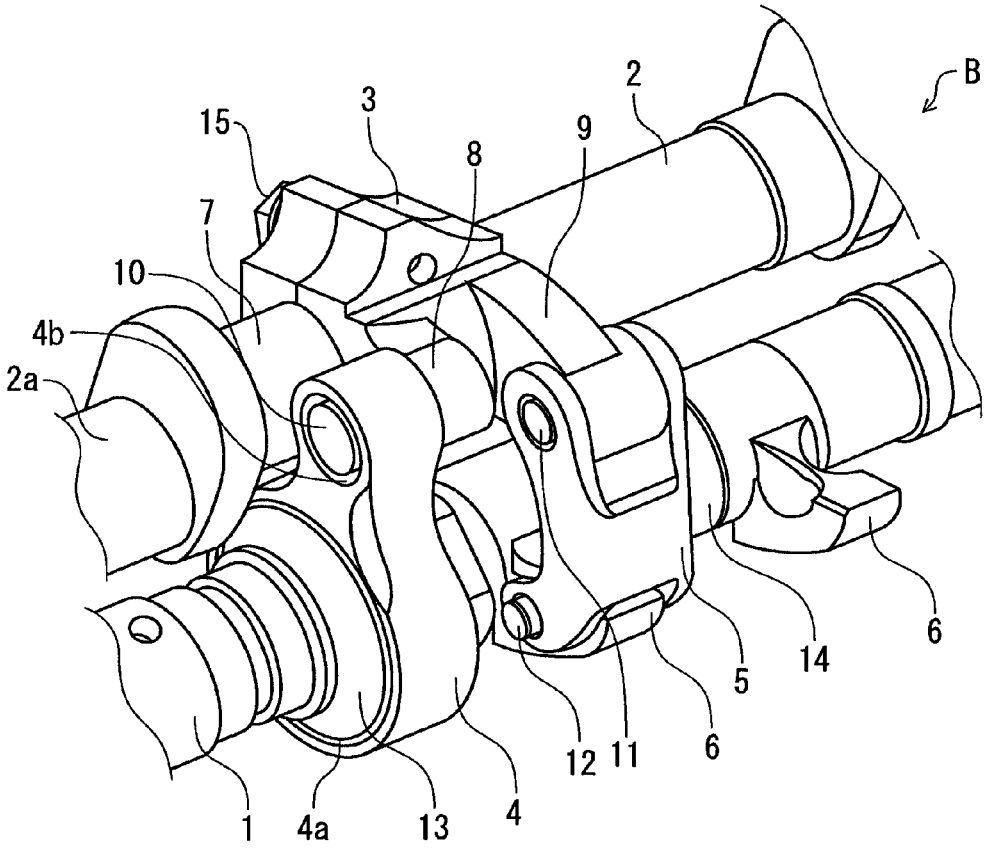
FIG. 8 is an exterior view of a variable valve device B to which the first embodiment is applied.

FIG. 8 is a constitutional diagram showing a variable valve device B to which this embodiment is applied. In this embodiment, a control shaft 2 and the drive shaft 1 are respectively supported to be free to rotate on a cam bracket provided in an upper portion of the cylinder head such that the control shaft 2 is substantially parallel to the drive shaft 1 and positioned further toward an engine upper side than the drive shaft 1.

The control shaft 2 takes a so-called crank shape, and includes a main journal 2*a* supported by the cam bracket, and the rocker shaft 7, which is offset from a center of the main journal 2*a*. Further, the control shaft 2 is rotated within a predetermined angle range by the motor 27 provided on one end portion thereof. A power supply to the motor 27 is controlled on the basis of a control signal from the control unit 100. The motor 27 functions not only to rotate the control shaft 2 to a target angle during modification of the operating angle, but also to hold the control shaft 2 such that the angle of the control shaft 2 does not deviate from the target angle during an operation.

A sensor that detects a rotation angle of the drive shaft 1 and a sensor that detects a rotation angle of the control shaft 2 are further provided, and detection values from these sensors are read to the control unit 100.

Since the rocking shaft 7 is offset from a rotary axis of the control shaft 2 (the center of the main journal 2*a*), a rocking center position of the variable valve rocker arm 3 when the engine is seen from a front surface varies according to the rotation angle of the control shaft 2. Hence, when the rotation angle of the control shaft 2 is varied by the motor 27, the rocking center position of the variable valve rocker arm 3 shifts, causing the initial rocking position of the rocker cam 6, and therefore the operating angle of the intake valve, to vary.

Figure 9:
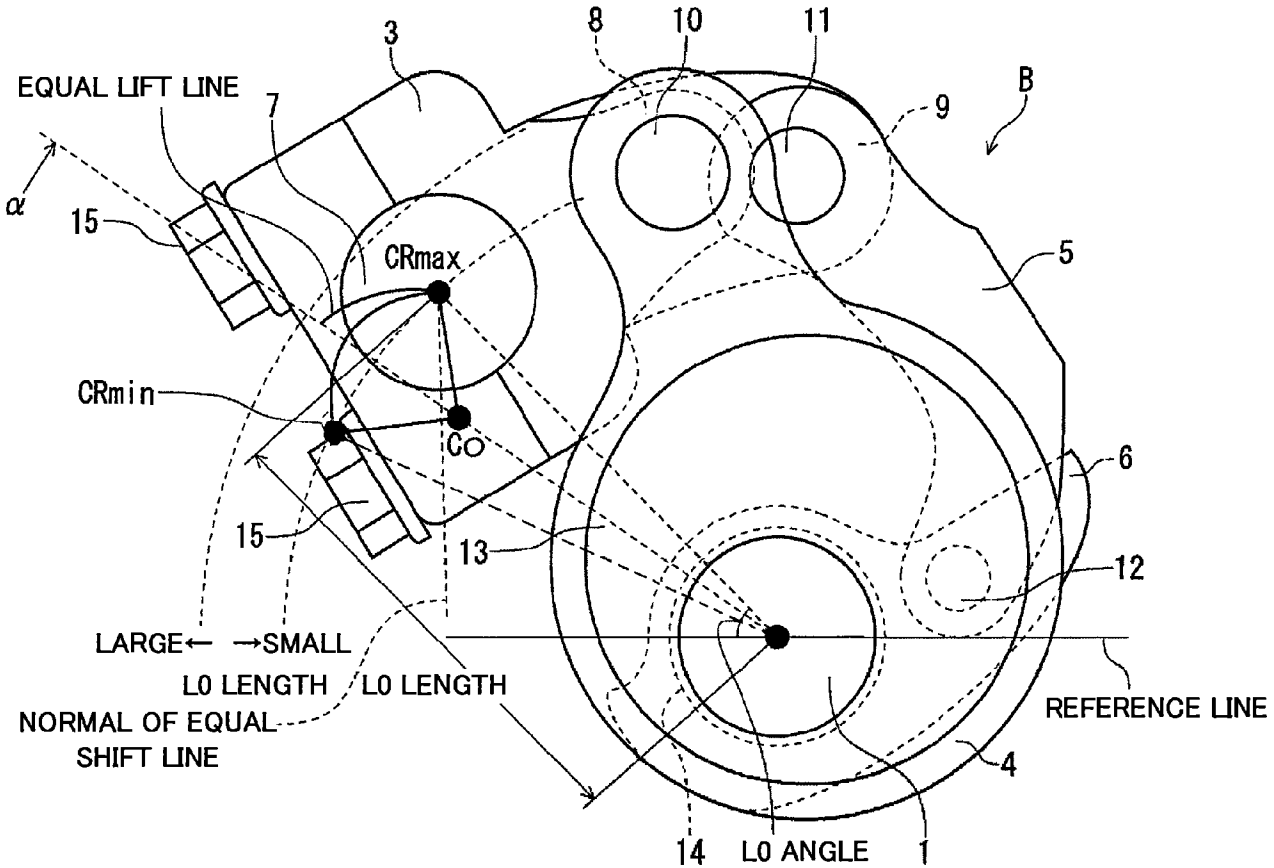
FIG. 9 is a view showing the basic constitution of the variable valve device B to which the first embodiment is applied.

FIG. 9 is a view showing the variable valve device B from the front (front surface) of the engine, similarly to FIG. 1. A reference symbol C0 in FIG. 9 denotes the rotary axis of the control shaft 2 (the center of the main journal 2*a*), while CRmax and CRmin denote a center position of the rocker shaft 7 at the maximum operating angle and the minimum operating angle, respectively.

When the L0 length and L0 angle are varied as described above, the valve lift varies. For example, the valve lift increases as the L0 length increases and decreases as the L0 angle decreases. When the L0 length is increased using this characteristic such that the valve lift increases by an amount corresponding to a reduction in the valve lift generated by a reduction in the L0 angle, the valve lift does not vary. By varying the L0 length by an amount that cancels out variation in the valve lift generated by variation in the L0 angle in this manner, variation in the maximum valve lift accompanying modification of the operation angle can be suppressed. As a result, a situation in which the valve lift in the vicinity of the maximum operating angle increases excessively such that the maximum lift becomes excessively large, leading to an increase in mechanical loss (for example, the work required to counteract a valve spring reaction force) and a deterioration in efficiency, is prevented. An "equal lift line" in FIG. 9 denotes the locus (an imaginary line) of the rocker shaft 7 when the L0 length and L0 angle are varied to keep the valve lift constant.

Disposal of the control shaft 2 will now be described. The control shaft 2 is disposed to satisfy the following three conditions. FIG. 9 shows an example of a case in which all three conditions are satisfied.

A first condition is satisfied when the L0 length at the maximum operating angle is equal to or greater than the L0 length at the minimum operating angle.

A second condition is satisfied when L0 angle max$-\alpha \cong \alpha-$ L0 angle min, where $\alpha$ is an angle formed by a straight line linking the rotary axis C0 of the control shaft 2 (the center of the main journal 2*a*) to the center of the drive shaft 1 and a reference line, L0 angle max is the L0 angle at the maximum operating angle, and L0 angle min is the L0 angle at the minimum operating angle, and when the rotary axis C0 of the control shaft 2 is on the same side of a normal of the equal lift line in the center CRmax of the rocker shaft 7 at the maximum operating angle as the drive shaft 1.

A third condition is satisfied when an arc traced by the center of the rocker shaft 7 as it rotates about the rotary axis C0 of the control shaft 2 approaches the equal lift line in the center position CRmax of the rocker shaft 7 at the maximum operating angle in the center position CRmax of the rocker shaft 7 at the maximum operating angle.

Next, effects obtained when these conditions are satisfied will be described.

Figure 10:
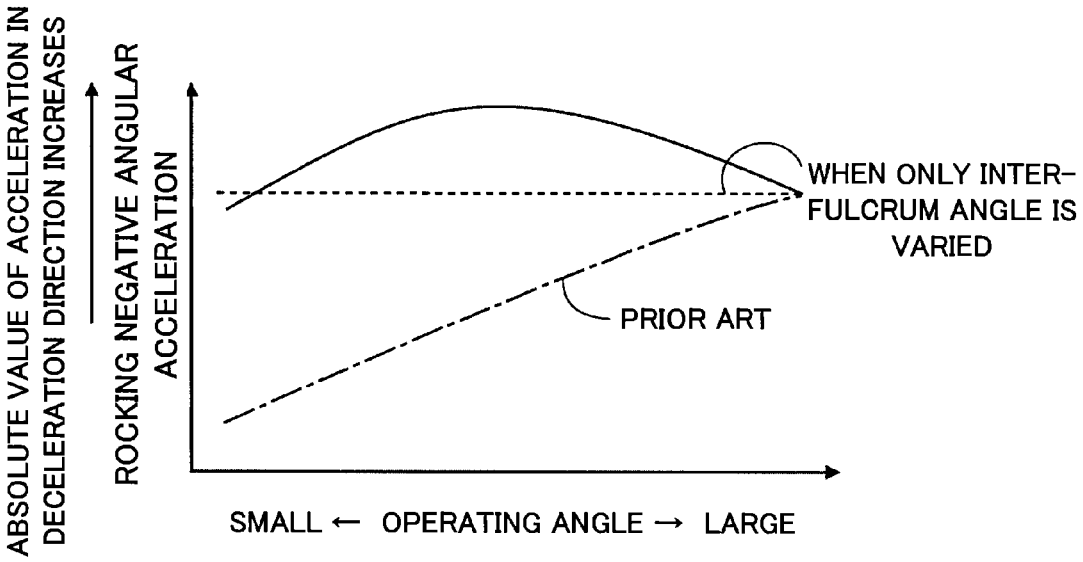
FIG. 10 is a view showing a relationship between the rocking negative angular acceleration and the operating angle.
Figure 11:
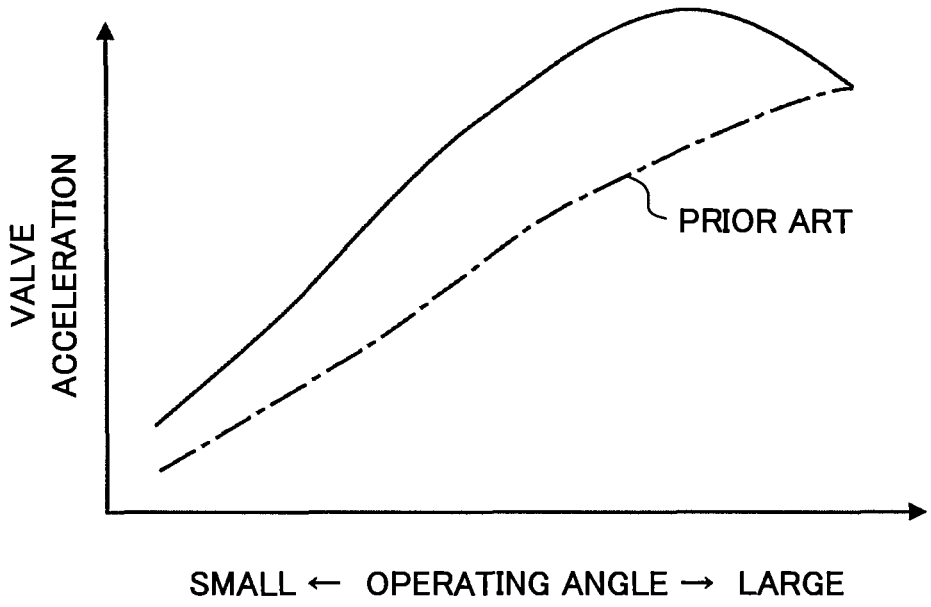
FIG. 11 is a view showing a relationship between a valve acceleration and the operating angle.
Figure 12:
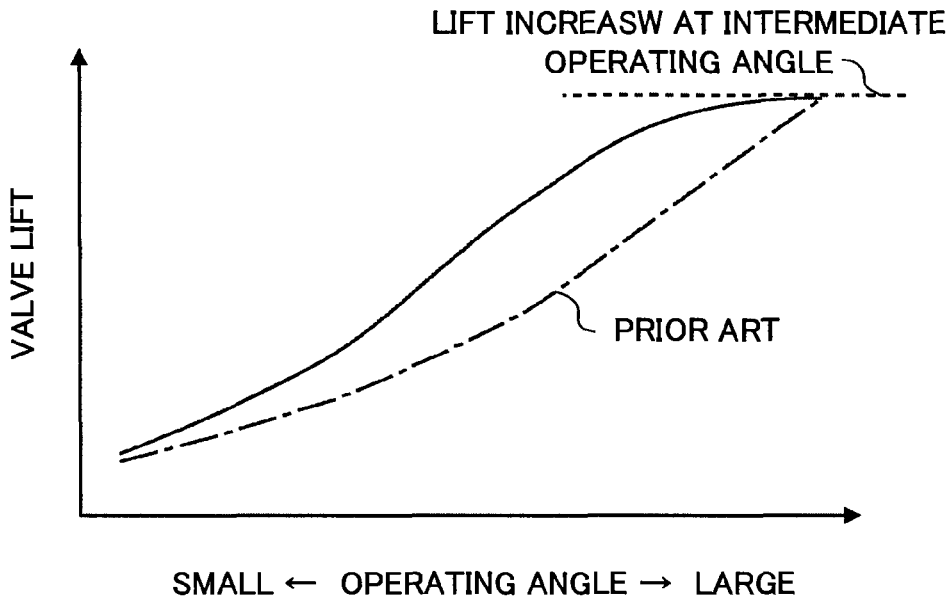
FIG. 12 is a view showing a relationship between a valve lift and the operating angle.

FIG. 10 shows a relationship between the rocking negative angular acceleration and the operating angle. FIG. 11 shows a relationship between the valve acceleration and the operating angle. FIG. 12 shows a relationship between the valve lift and the operating angle. For comparison, each figure also shows a mechanism such as that disclosed in JP2002-

38913A, in which a shaft corresponding to the control shaft 2 of this embodiment is offset from the rocker shaft and the operating angle is varied by varying mainly the L0 length with substantially no variation in the L0 angle (referred to as "Prior Art" in the figures). The ordinate in FIG. 10 shows an absolute value of negative angular acceleration (angular acceleration in a deceleration direction).

As shown in FIG. 10, in the prior art, the rocking negative angular acceleration decreases when the operating angle is reduced below the maximum operating angle. The reason for this is that in the prior art, variation in the L0 angle relative to variation in the L0 length is small, and therefore a variable control width of the operating angle must be secured by variation in the L0 length, leading to a reduction in the rocking negative angular acceleration, as shown in FIG. 5.

Meanwhile, when only the L0 angle is varied (a broken line in FIG. 10), the rocking negative angular acceleration remains constant from the maximum operating angle to the minimum operating angle, as described above.

In this embodiment, on the other hand, the rocking negative angular acceleration at the maximum operating angle and the minimum operating angle is equal to the rocking negative angular acceleration when only the L0 angle is varied, while the rocking negative angular acceleration at an intermediate operating angle is larger than the rocking negative angular acceleration at the maximum operating angle.

The reason for this, as is evident from the locus of the center position of the rocker shaft 7 in FIG. 9, is that the L0 length is longer at the intermediate operating angle than at the maximum operating angle, and therefore the rocking negative angular acceleration increases beyond the rocking negative angular acceleration at the maximum operating angle. In other words, at the intermediate operating angle, the L0 angle is smaller and the L0 length is longer than at the maximum operating angle, and therefore the rocking negative angular acceleration remains constant when the L0 angle is reduced, as shown in FIG. 6, and increases when the L0 length is increased, as shown in FIG. 5.

When the L0 length is increased, the rocking angle increases (see FIG. 5), and as a result, the operating angle varies in an increasing direction. However, the reduction in the rocking angle caused by the reduction in the L0 angle is greater, and therefore the operating angle decreases. The reason for this, as described above, is that when the L0 length increases, the rocking angle of the rocker cam 6 per unit rotation angle of the drive shaft 1 increases, and therefore the increase in the L0 length acts powerfully to cause the rocking negative angular acceleration to increase beyond the increase in the operating angle (particularly when the operating angle is in the vicinity of a large operating angle).

As shown in FIG. 11, when the rocking negative angular acceleration of the rocker cam 6 has the characteristic described above, the valve acceleration is larger than that of the prior art over the entire operating angle region, takes a maximum value at an intermediate operating angle in the vicinity of the maximum operating angle, and is substantially equal to that of the prior art at the maximum operating angle.

Further, as shown in FIG. 12, the valve lift takes a larger value than that of the prior art at the intermediate operating angle and maintains a value close to the maximum lift in the vicinity of the maximum operating angle. The reason for this is that in the vicinity of the maximum operating angle, the locus of the rocker shaft 7 is close to the equal lift line. Furthermore, in this embodiment, the eccentricity of the rocker shaft 7 relative to the main journal of the control shaft 2 is set to be larger than that of the prior art, and therefore variation in the operating angle accompanying movement of the rocker shaft 7 is always oriented in a fixed direction. Moreover, the lift does not decrease relative to an increase in the operating angle. Hence, between an intermediate operating angle and a large operating angle, the rocker shaft displaces relative to the drive shaft such that variation in the maximum lift of the engine valve accompanying modification of the operating angle is suppressed in comparison with other operating angle ranges. Further, the rocker shaft displaces relative to the drive shaft such that variation in the maximum lift of the engine valve based on variation in the L0 angle and variation in the maximum lift of the engine valve based on variation in the L0 length cancel each other out. Furthermore, the rocker shaft displaces relative to the drive shaft such that the absolute value of the rocking negative angular acceleration at an intermediate operating angle is equal to or greater than the rocking negative angular acceleration at the maximum operating angle.

Hence, with this embodiment, the following effects can be obtained.

(1) The cam nose 6*a* of the rocker cam 6 projects to the second connecting portion 11 side of the straight line linking the drive shaft 1 to the rocker shaft 7, and the rocker cam 6 is connected to the second link 5 on the same side of this straight line as the cam nose 6*a*. The center position of the control shaft 7 moves such that as the operating angle increases, the L0 angle increases and the L0 length increases from the minimum operating angle to the predetermined operating angle and decreases from the predetermined operating angle to the maximum operating angle, and therefore the absolute value of the rocking negative angular acceleration reaches a maximum value at the intermediate operating angle. As a result, an improvement in charging efficiency and a reduction in pump loss can be achieved during a medium load operation, i.e. at an intermediate operating angle, and an excessive increase in the lift at a small operating angle can be prevented, thereby reducing variation in an intake air amount during a low load operation. Further, a situation in which the maximum lift in the vicinity of the maximum operating angle increases unnecessarily, leading to an increase in mechanical loss, can be prevented, and as a result, an input load input to the rocker shaft 7 at the maximum operating angle can be reduced.

(2) By setting the L0 length at the maximum operating angle to be equal to or greater than the L0 length at the minimum operating angle, the rocking angle of the rocker cam 6 per unit rotation angle of the drive shaft 1 can be increased beyond the rocking angle at the maximum operating angle, and as a result, the rocking negative angular acceleration in the vicinity of the maximum operating angle can be increased.

(3) The rocker shaft 7 moves along a locus that steadily approaches the equal lift line toward the maximum operating angle, and therefore the valve lift at the intermediate operating angle can be increased while suppressing the valve lift at the maximum operating angle.

(4) The rocking axis of the control shaft 2 is located on a straight line linking the rocking axis of the variable valve rocker arm 3 and the rocking axis of the rocker cam 6 when the operating angle is substantially half the maximum operating angle, and positioned on the rocking axis 1 side of the rocker cam 6 relative to the normal of the equal lift line in the rocking axis position of the rocker shaft 7 at the maximum operating angle. Therefore, an equal lift can be maintained in the vicinity of the maximum operating angle using the control shaft 2 having an eccentric rocking axis.

A second embodiment of this invention will now be described.

Figure 13:
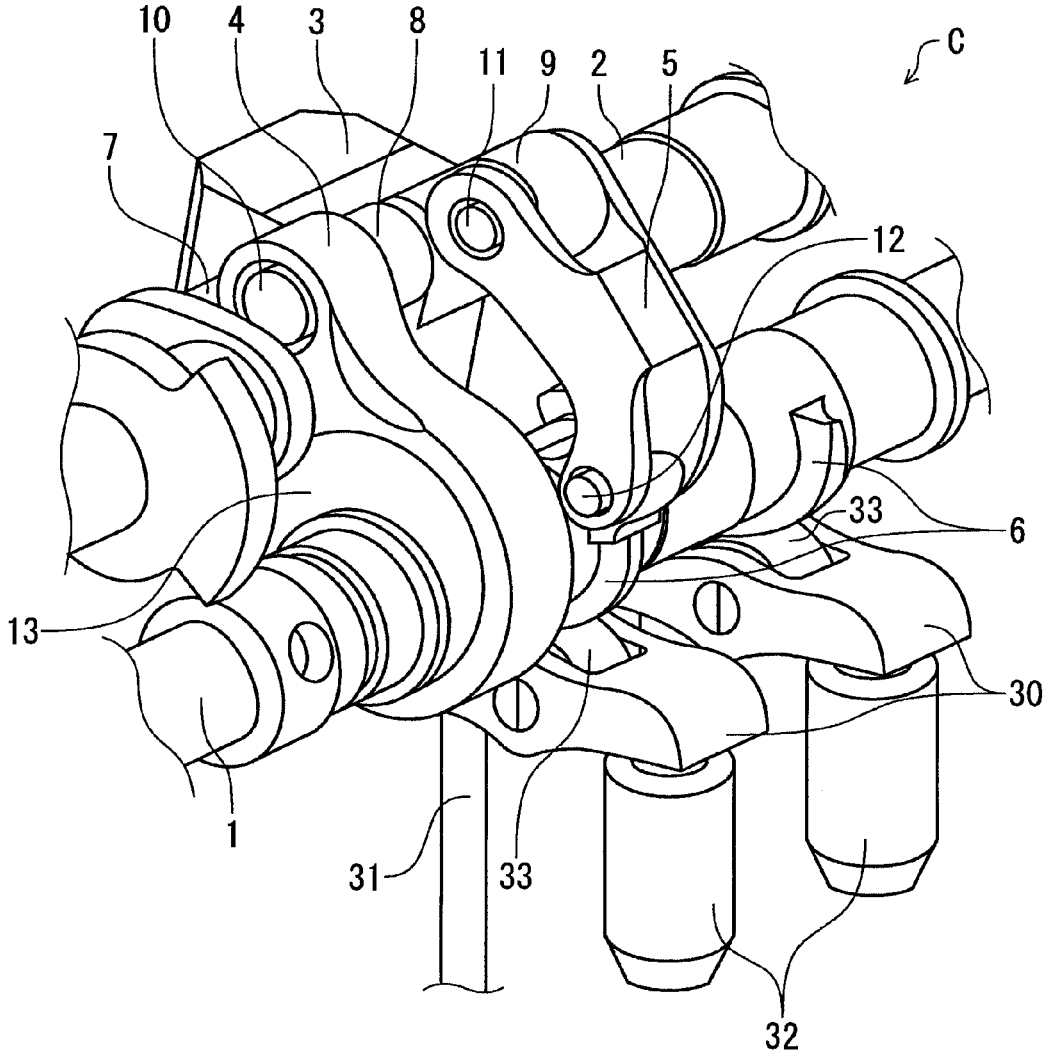
FIG. 13 is an exterior view of a variable valve device C to which a second embodiment of this invention is applied.
Figure 14:
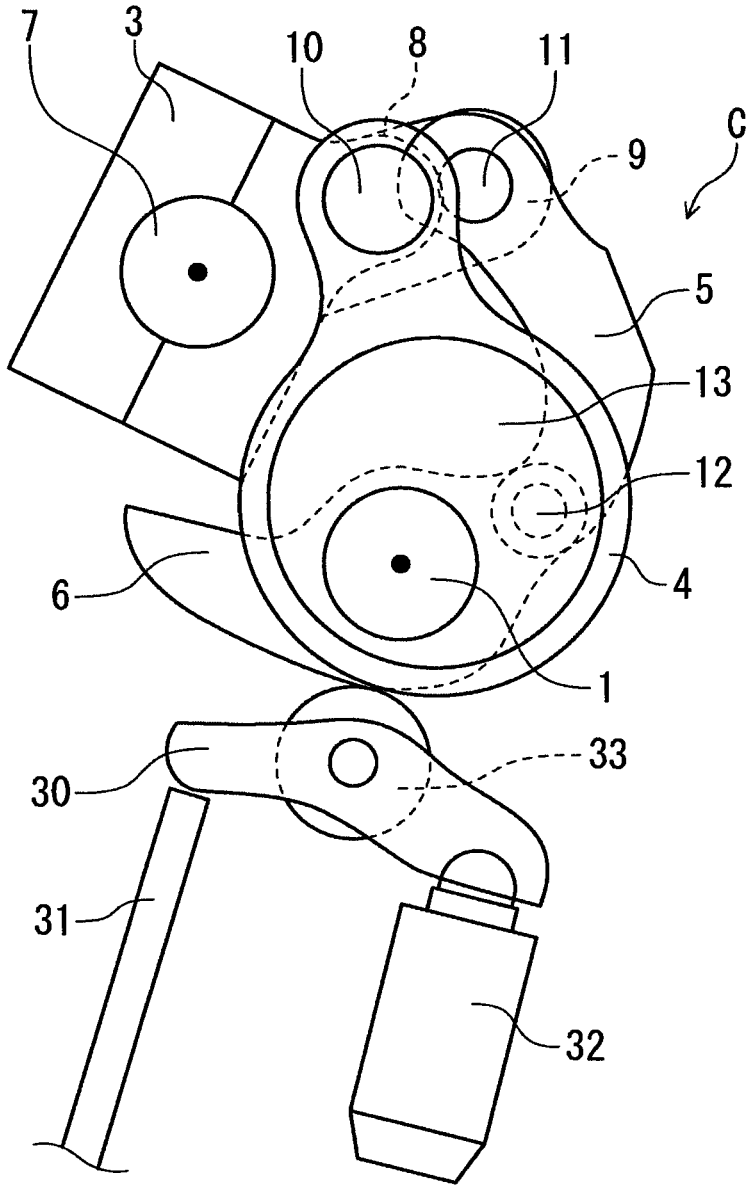
FIG. 14 is a view showing the variable valve device C from an engine front surface.

FIG. 13 is an exterior view of a variable valve device C to which this embodiment is applied, and FIG. 14 is a view showing the variable valve device C from the engine front surface.

This embodiment is similar to the first embodiment in the arrangement of the variable valve rocker arm 3, first arm 8, second arm 9, first link 4, and second link 5 and in that the control shaft 2 is formed in a crank shape, but differs from the first embodiment in the orientation of the rocker cam 6 and the rotary axis position of the control shaft 2.

This embodiment also differs from the first embodiment in that the rocker cam 6 drives an intake valve 31 via a roller type rocker arm 30 having a roller follower 33, and a lash adjuster 32 is disposed on a fulcrum of the roller type rocker arm 30. The rotary axis position of the control shaft 2 will be described below.

The rocker cam 6 includes a cam surface that projects to the opposite side of a line linking the control shaft 2 and the rotary axis of the drive shaft 1 to a projection direction of the first and second arms, and is connected to the second link 5 on the opposite side of the rotary axis of the drive shaft 1 to the cam surface. When the drive shaft 1 rotates such that the first link 4 moves upward, the second link 5 is also pulled upward, causing the rocker cam 6 to rotate in a counter-clockwise direction of FIG. 14 such that the intake valve 31 is pushed downward via the roller type rocker arm 30.

Further, the roller type rocker arm 30 is formed such that a contact portion with the intake valve 31 and the fulcrum thereof are located below a contact portion between the roller follower 33 and the rocker cam 6. Thus, a rocking locus of the connecting pin 12 can be secured. In other words, a situation in which a connecting part between the rocker cam 6 and the second link 5 collides with the roller type rocker arm 30 when the rocker cam 6 rocks can be avoided.

Figure 15:
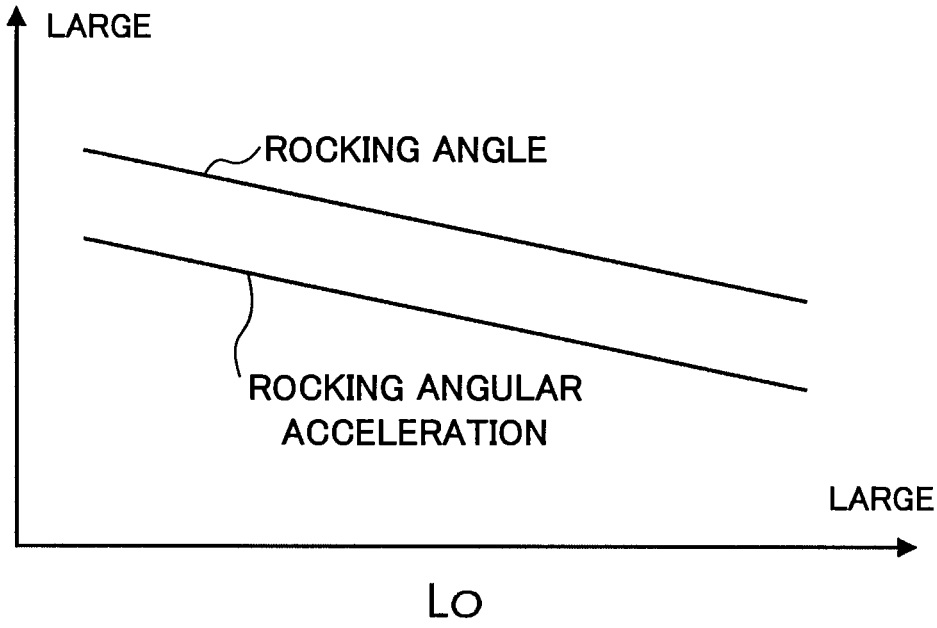
FIG. 15 is a view summarizing the relationship of the L0 length with the rocking angle and the rocking negative angular acceleration.
Figure 16:
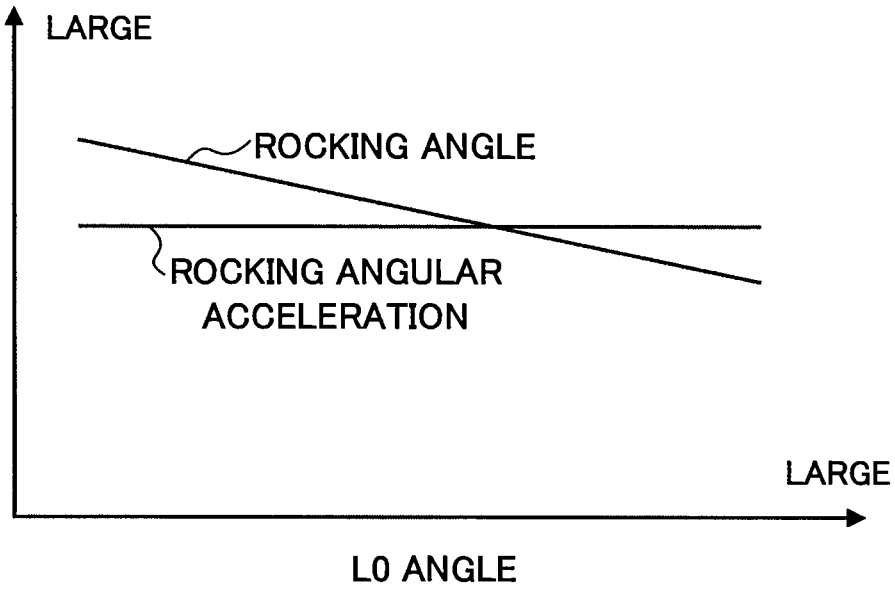
FIG. 16 is a view summarizing the relationship of the L0 angle with the rocking angle and the rocking negative angular acceleration.

FIG. 15 and FIG. 16 are views corresponding to FIG. 5 and FIG. 6, i.e. views summarizing the relationships of the L0 length and the L0 angle to the rocking angle and rocking negative angular acceleration, respectively.

As shown in FIG. 15, the rocking angle and the rocking angular acceleration decrease as the L0 length increases. As shown in FIG. 16, when the L0 angle increases, the rocking angle decreases while the rocking angular acceleration remains constant.

Figure 17:
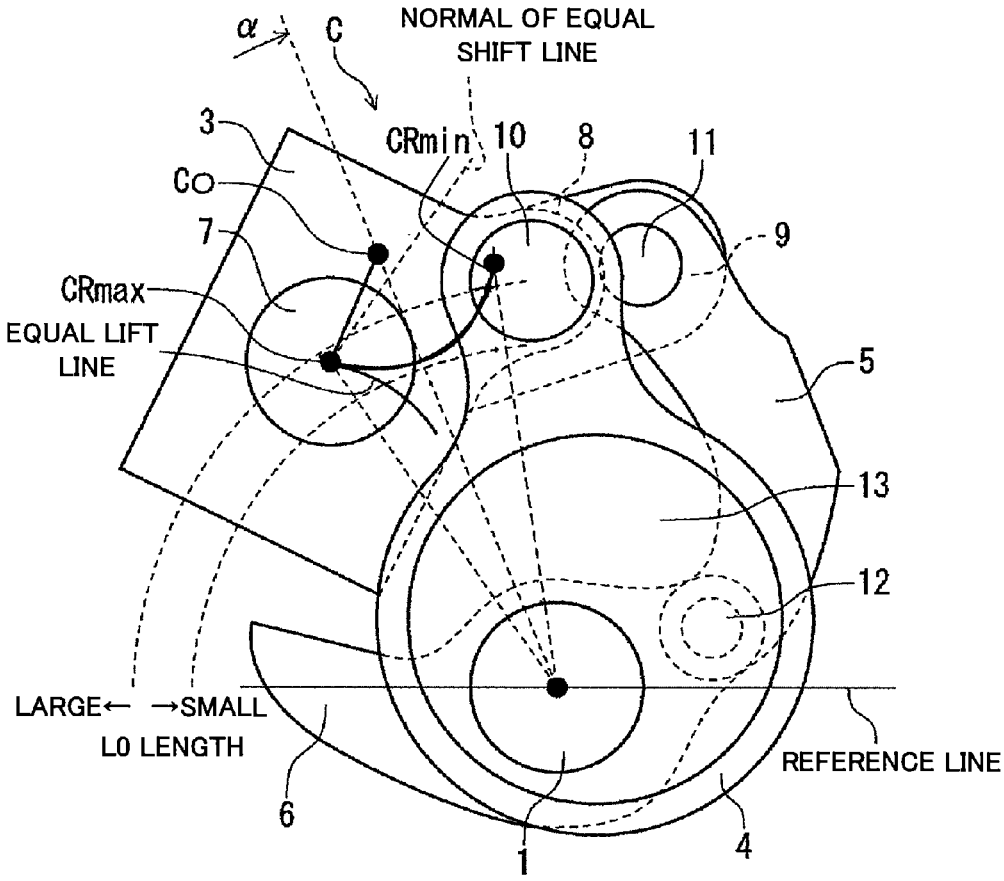
FIG. 17 is a view illustrating a rotary shaft position of a control shaft 2 according to the second embodiment.

FIG. 17 is a view illustrating the rotary axis position of the control shaft 2 according to this embodiment. Similarly to FIG. 9, C0 denotes the rotary axis of the control shaft 2 while CRmax and CRmin denote the center position of the rocker shaft 7 at the maximum operating angle and the minimum operating angle, respectively. The reference line and the angle formed by the line linking the rotary axis C0 of the control shaft 2 and the rotary axis of the drive shaft 1 and the reference line are also similar to FIG. 9.

Disposal of the control shaft 2 will now be described. The control shaft 2 is disposed to satisfy the following three conditions. FIG. 17 shows an example of a case in which all three conditions are satisfied.

A first condition is satisfied when L0 angle max$-\alpha \cong \alpha-$L0 angle min, where $\alpha$ is the angle formed by the straight line linking the rotary axis C0 of the control shaft 2 to the drive shaft 1 and the reference line, L0 angle max is the L0 angle at the maximum operating angle, and L0 angle min is the L0 angle at the minimum operating angle, or in other words when the L0 length at the maximum operating angle is equal to or greater than the L0 length at the minimum operating angle.

A second condition is satisfied when the rotary axis C0 of the control shaft 2 is on the opposite side of the normal of the equal shift line in the center CRmax of the rocker shaft 7 at the maximum operating angle to the drive shaft 1.

A third condition is satisfied when a center position distance between the rotary axis C0 and the rocker shaft 7 is set such that the locus of the center of the rocker shaft 7 when the control shaft 2 is rotated, or in other words an arc having the rotary axis C0 of the control shaft 2 as a center and the center position distance between the rotary axis C0 and the rocker shaft 7 as a radius, approaches the equal lift line as it comes closer to the center position CRmax of the rocker shaft 7 at the maximum operating angle from the center position CRmin of the rocker shaft 7 at the minimum operating angle and the two match in the center position CRmax of the rocker shaft 7 at the maximum operating angle.

Next, the effect when all the conditions are satisfied will be described.

Figure 18:
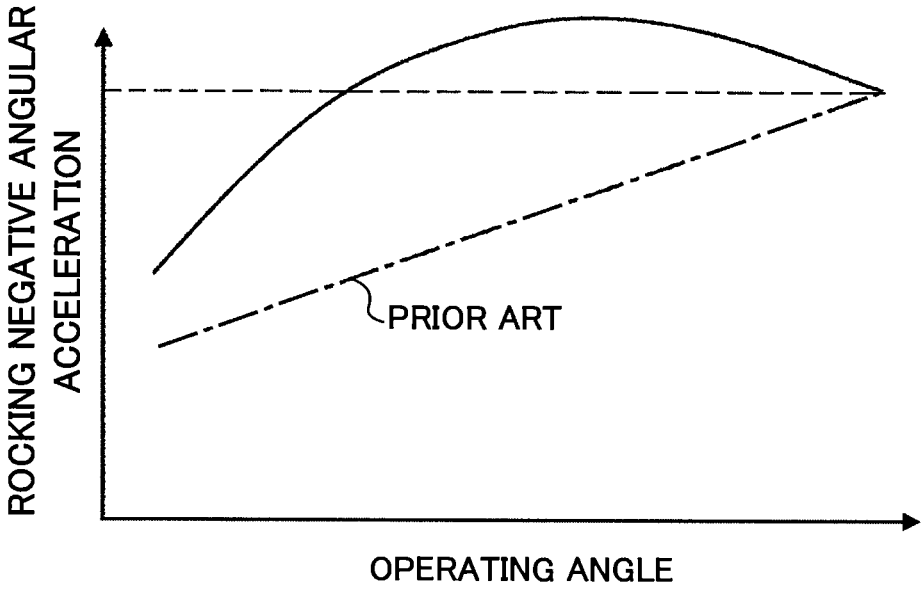
FIG. 18 is a view showing the relationship between the rocking negative angular acceleration and the operating angle.
Figure 19:
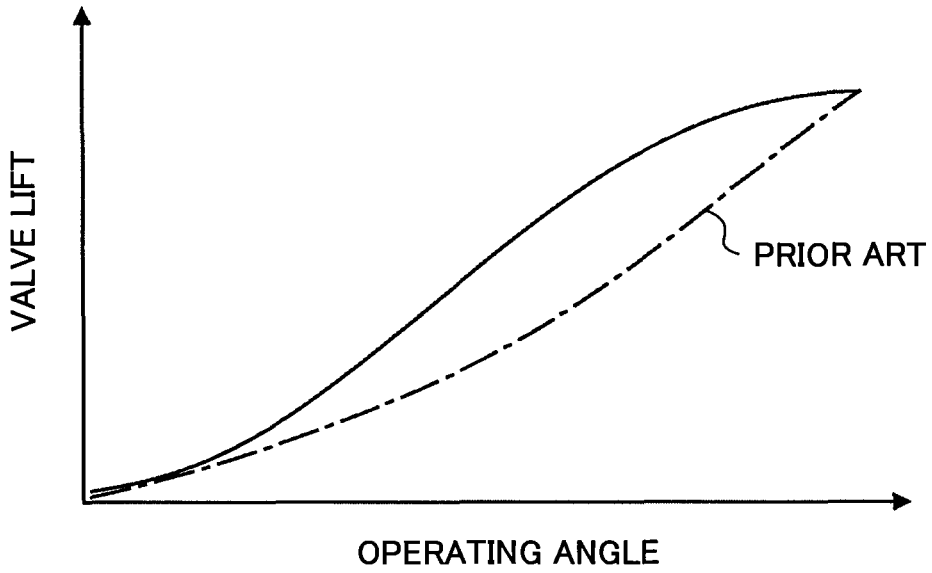
FIG. 19 is a view showing the relationship between the valve lift and the operating angle.

FIG. 18 shows a relationship between the rocking negative angular acceleration and the operating angle. FIG. 19 shows a relationship between the valve lift and the operating angle. Similarly to FIG. 10 and FIG. 12, each figure also shows the prior art as a comparison. The ordinate of FIG. 18 shows an absolute value of negative angular acceleration (angular acceleration in a deceleration direction), similarly to FIG. 10.

As shown in FIG. 18, in the prior art, the rocking negative angular acceleration decreases when the operating angle decreases from the maximum operating angle. In this embodiment, on the other hand, the rocking negative angular acceleration is identical to that of the prior art at the maximum operating angle and larger than that of the maximum operating angle at an intermediate operating angle.

The reason for this, as is evident from the locus of the center position of the rocker shaft 7 shown in FIG. 17, is that at the maximum operating angle and the minimum operating angle, the L0 length is identical to that of a case in which only the L0 angle is varied, but at the intermediate operating angle, the L0 length is shorter than at the maximum operating angle.

In other words, at the intermediate operating angle, the L0 angle is larger and the L0 length is shorter than at the maximum operating angle, and when the L0 angle is increased, as shown in FIG. 16, the operating angle decreases while the rocking negative angular acceleration remains constant, while when the L0 length is shortened, as shown in FIG. 15, the rocking negative angular acceleration increases.

When the rocking negative angular acceleration of the rocker cam 6 has the characteristic described above, the valve lift is larger than that of the prior art over substantially the entire region, as shown in FIG. 19, and approaches a substantially maximum lift at an intermediate operating angle approaching the maximum operating angle. The reason for this is that in the vicinity of the maximum operating angle, the locus of the rocker shaft 7 is close to the equal lift line.

In the embodiment described above, the cam nose **6*a* of the rocker cam 6 projects to the opposite side of the straight line linking the drive shaft 1 and the rocker shaft 7 to the second link 5, and the rocker cam 6 is connected to the second link 5 on the same side of this straight line as the cam nose 6*a*. When an operating angle modification mechanism is constituted to shift the position of the rocker shaft of the variable valve rocker arm along a locus on which the L0 angle decreases as the operating angle increases, the L0 length decreases from the minimum operating angle to the predetermined operating angle, and the L0** length increases from the predetermined operating angle to the maximum operating angle, similar effects to those of the first embodiment can be obtained.

A third embodiment of this invention will now be described.

Figure 20:
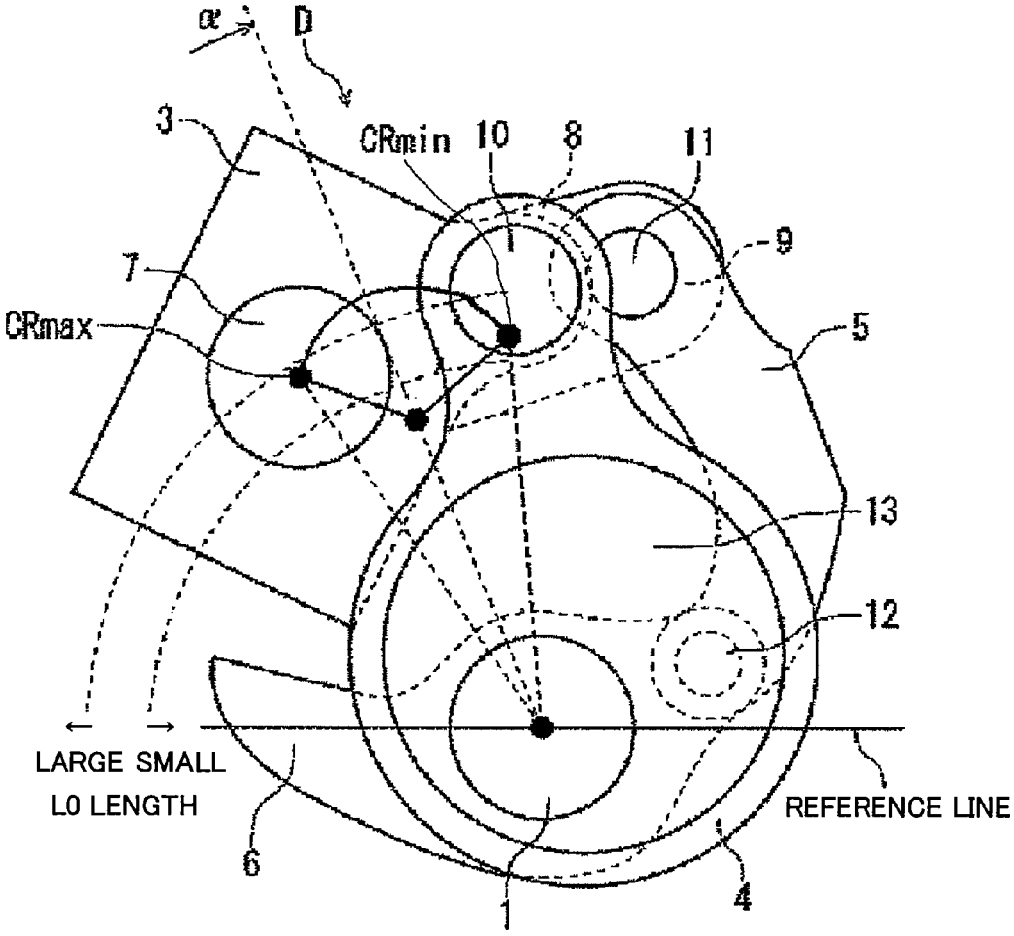
FIG. 20 is a view showing a variable valve device D to which a third embodiment of the invention is applied from the engine front surface.

FIG. 20 is a view showing a variable valve device D to which this embodiment is applied from the engine front surface, similarly to FIG. 17. FIG. 20 differs from FIG. 17 only in the position of the rotary axis C0 of the control shaft 2, and therefore this point will now be described.

In this embodiment also, the control shaft 2 is disposed to satisfy the following two conditions. FIG. 20 shows an example of a case in which the two conditions are satisfied.

A first condition is satisfied when the angle a formed by the straight line linking the rotary axis C0 of the control shaft 2 to the drive shaft 1 and the reference line, L0 angle max, and L0 min have a relationship of L0 angle max−α≅α−L0 angle min, or in other words when the L0 length at the maximum operating angle is equal to or greater than the L0 length at the minimum operating angle.

A second condition is satisfied when the rotary axis C0 of the control shaft 2 is positioned between the normal of the equal lift line in the center CRmax of the rocker shaft 7 at the maximum operating angle and a straight line linking the center position CRmax of the rocker shaft 7 at the maximum operating angle to the rotary axis C0 and close to the normal.

Next, effects obtained when all of these conditions are satisfied will be described.

Figure 21:
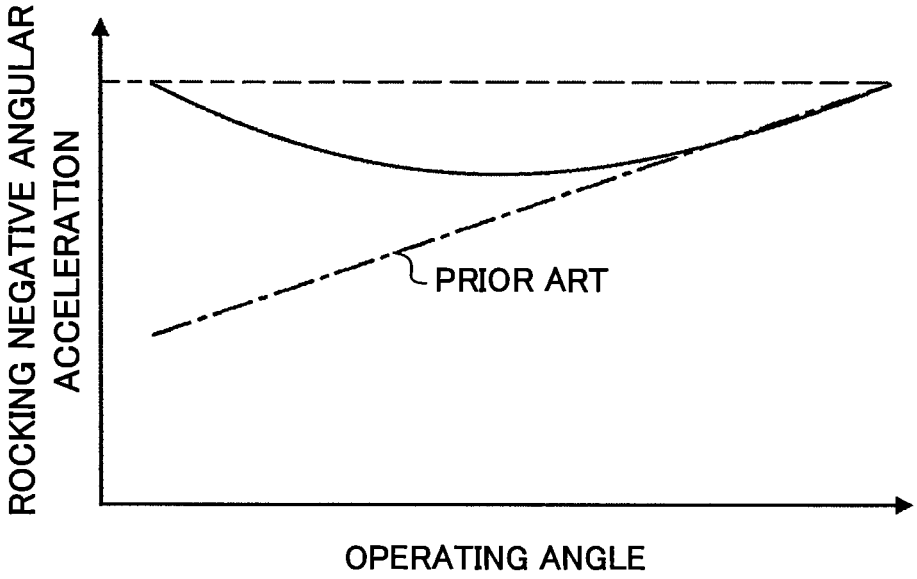
FIG. 21 is a view showing the relationship between the rocking negative angular acceleration and the operating angle.
Figure 22:
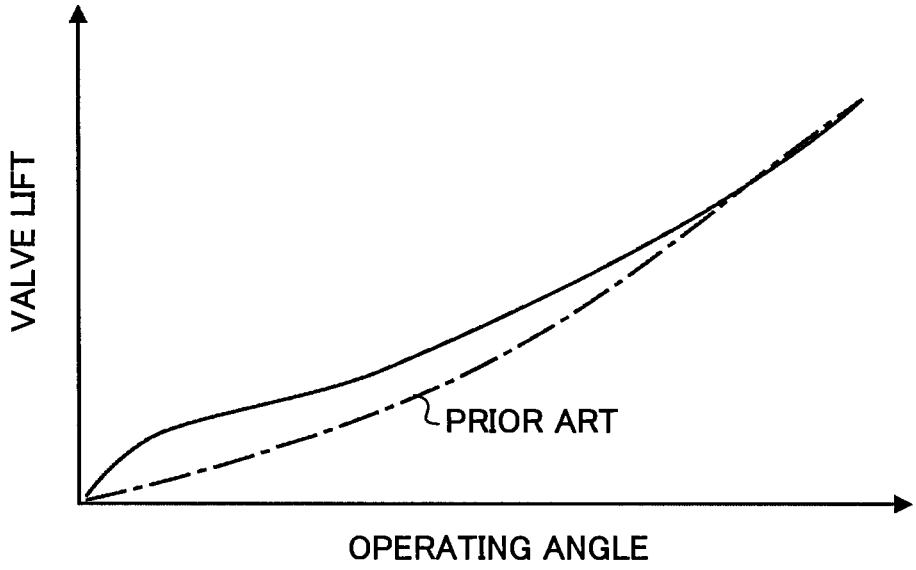
FIG. 22 is a view showing the relationship between the valve lift and the operating angle.

FIG. 21 is a view showing a relationship between the rocking negative angular acceleration and the operating angle, and FIG. 22 is a view showing a relationship between the valve lift and the operating angle. Similarly to FIG. 10 and FIG. 12, the prior art is shown in each figure for comparison. The ordinate in FIG. 21 shows an absolute value of negative angular acceleration (angular acceleration in a deceleration direction), similarly to FIG. 10.

As shown in FIG. 21, in the prior art, the rocking negative angular acceleration decreases when the operating angle is reduced below the maximum operating angle. In this embodiment, on the other hand, the rocking negative angular acceleration is at a maximum at the minimum operating angle, decreases gradually therefrom as the operating angle increases, and increases again from an intermediate operating angle between the maximum operating angle and the minimum operating angle. The rocking negative angular acceleration then becomes substantially equal to that of the prior art as it approaches the maximum operating angle.

The reason for this, as is evident from the locus of the center position of the rocker shaft 7 shown in FIG. 20, is that at the maximum operating angle and the minimum operating angle, the L0 length is identical to that of a case in which only the L0 angle is varied, but at the intermediate operating angle, the L0 length increases beyond that of the maximum operating angle.

In other words, at the intermediate operating angle, the L0 angle and the L0 length are both larger than at the maximum operating angle. As shown in FIG. 16, when the L0 angle increases, the operating angle decreases while the rocking negative angular acceleration remains constant, and as shown in FIG. 15, when the L0 length increases, the rocking negative angular acceleration decreases.

As shown in FIG. 21, when the rocking negative angular acceleration of the rocker cam 6 has the characteristic described above, the valve lift is equal to that of the prior art in the vicinity of the maximum operating angle and at the minimum operating angle and only slightly different to that of the prior art at an intermediate operating angle close to the maximum operating angle. However, as the operating angle decreases, the difference between the valve lift of this embodiment and the valve lift of the prior art increases.

Hence, with this embodiment, the following effect can be obtained in addition to similar effects to those of the first and second embodiments relating to the constitution whereby the cam nose 6*a* of the rocker cam 6 projects to the opposite side of the straight line linking the drive shaft 1 and the rocking axis of the rocker shaft 7 to the second link 5 and the rocker cam 6 is connected to the second link 5 on the same side of this straight line as the cam nose 6*a*.

The control shaft 2 supported rotatably by the engine and the rocker shaft 7 offset therefrom are provided, and the distance from the drive shaft 1 to the center of the control shaft 2 is shorter than the L0 length at the minimum operating angle, and therefore the absolute value of the rocking negative angular acceleration at substantially the minimum operating angle increases. As a result, the lift at a small operating angle can be increased.

A fourth embodiment of this invention will now be described.

Figure 23:
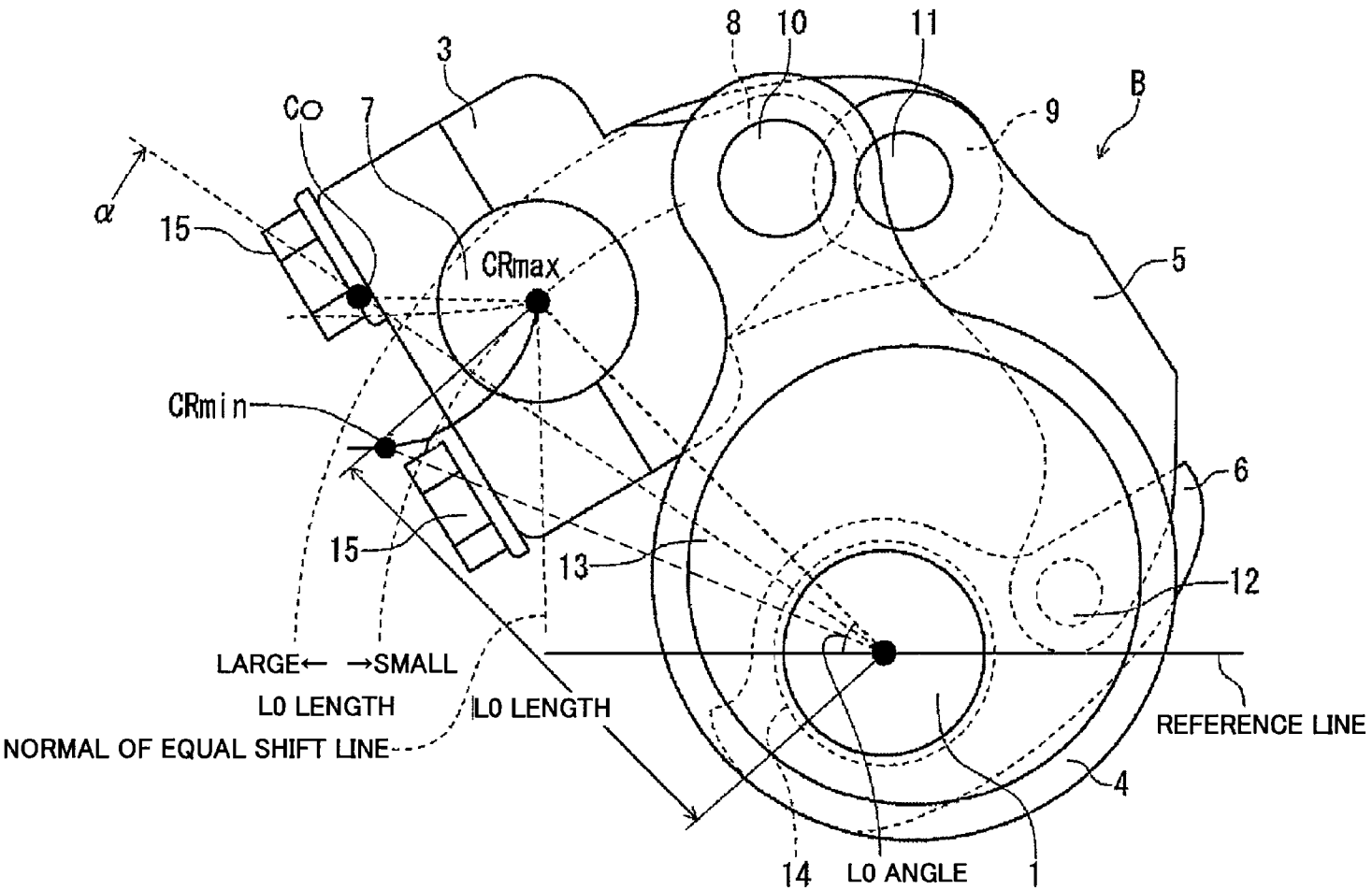
FIG. 23 is a view showing a variable valve device B to which a fourth embodiment of the invention is applied from the engine front surface.

FIG. 23 is a view showing a variable valve device B to which this embodiment is applied from the engine front surface, similarly to FIG. 9. FIG. 23 differs from FIG. 9 only in the position of the rotary axis C0 of the control shaft 2, and therefore this point will now be described.

In this embodiment also, the control shaft 2 is disposed to satisfy the following two conditions. FIG. 23 shows an example of a case in which the two conditions are satisfied.

A first condition is satisfied when the angle a formed by the straight line linking the rotary axis C0 of the control shaft 2 to the drive shaft 1 and the reference line, L0 angle max, and L0 min have a relationship of L0 angle max−α≅α−L0 angle min, or in other words when the L0 length at the maximum operating angle is equal to or greater than the L0 length at the minimum operating angle.

A second condition is satisfied when the rotary axis C0 of the control shaft 2 is positioned on the opposite side of the normal of the equal shift line in the center CRmax of the rocker shaft 7 at the maximum operating angle to the drive shaft 1.

When all of these conditions are satisfied, similar effects to those shown in FIG. 21 and FIG. 22 are obtained.

In the above embodiments, a variable valve device for an intake valve was described, but this invention may be applied similarly to the opening and closing of an exhaust valve.

For example, when a valve lift that is close to the valve lift at substantially the maximum operating angle is obtained at an intermediate operating angle close to the maximum operating angle, as in the first and second embodiments, an improvement in discharge efficiency during medium and high load operations and so on can be achieved. Further, when the valve lift is increased in the small operating angle region, as in the third and fourth embodiments, a reduction in a residual gas amount can be achieved during low load operations such as idle operations.

This invention is not limited to the embodiments described above, and may of course be subjected to various modifications within the scope of the technical spirit described in the claims.

In relation to the above description, Patent Application No. 2007-209706, with a filing date of Aug. 10, 2007 in Japan, Patent Application No. 2007-214529, with a filing date of Aug. 21, 2007 in Japan, Patent Application No. 2008-043126, with a filing date of Feb. 25, 2008 in Japan, and Patent Application No. 2008-047918, with a filing date of Feb. 28, 2008 in Japan, are incorporated herein by reference.

INDUSTRIAL APPLICABILITY

As described above, this invention is capable of suppressing variation in a maximum lift when an operating angle of a rocker cam is varied. Therefore, particularly favorable effects can be obtained when this invention is applied to a variable valve device capable of controlling a lift or an operating angle of an engine valve variably and continuously.

Exclusive properties or features encompassed by the embodiments of this invention are as claimed below.

The invention claimed is:

1. A variable valve device comprising:

a drive shaft configured to rotate in synchronization with a crankshaft of an engine;

a drive cam provided on the drive shaft;

a rocker cam pivotally supported on the drive shaft;

an engine valve configured to be driven to open and close by the rocker cam;

a rocker shaft disposed parallel to the drive shaft;

a rocker arm pivotally supported on the rocker shaft;

a first link that links the rocker arm and the drive cam;

a second link that links the rocker arm and the rocker cam; and a rocker shaft position modifying section configured to modify a position of the rocker shaft relative to the drive shaft to control an operating angle and a lift of the engine valve, wherein the rocker shaft position modifying section is configured to modify the position of the rocker shaft relative to the drive shaft such that a variation of a maximum lift of the engine valve per unit change of the operating angle within a predetermined operating angle range of the engine valve is suppressed as compared to a variation of a maximum lift of the engine valve per unit change of the operating angle outside of the predetermined operating angle range.

2. The variable valve device as defined in claim 1, wherein, in the predetermined operating angle range, the rocker shaft position modifying section is configured to modify the position of the rocker shaft relative to the drive shaft such that, when viewed from a front surface of the engine, a maximum lift variation of the engine valve based on an angular variation of a straight line linking a center of the drive shaft and a center of the rocker shaft and a maximum lift variation of the engine valve based on a variation of a distance between the center of the drive shaft and the center of the rocker shaft cancel each other.

3. The variable valve device as defined in claim 1, wherein when viewed from a front surface of the engine, a first connection point between the rocker arm and the first link and a second connection point between the rocker arm and the second link are on a same side of a straight line linking a center of the drive shaft and a center of the rocker shaft, the second connection point being positioned farther from the center of the rocker shaft than the first connection point, the rocker cam includes a cam nose positioned on the same side of the straight line as the first connection point and the second connection point, and a rotation direction of the drive shaft is equal to a rotation direction of the rocker cam during opening of the engine valve.

4. The variable valve device as defined in claim 3, wherein, in the predetermined operating angle range, the distance between the center of the drive shaft and the center of the rocker shaft decreases as the operating angle increases.

5. The variable valve device as defined in claim 4, wherein the predetermined operating angle range is from a predetermined operating angle between a minimum operating angle and a maximum operating angle to the maximum operating angle.

6. The variable valve device as defined in claim 4, wherein the predetermined operating angle range is from a minimum operating angle to a predetermined operating angle between the minimum operating angle and a maximum operating angle.

7. The variable valve device as defined in claim 1, wherein when viewed from a front surface of the engine, a first connection point between the rocker arm and the first link and a second connection point between the rocker aim and the second link are on a same side of the straight line linking a center of the drive shaft and a center of the rocker shaft, the second connection point being positioned farther from the center of the rocker shaft than the first connection point, the rocker cam includes a cam nose positioned on a different side of the straight line to the first connection point and the second connection point, and a rotation direction of the drive shaft is opposite to a rotation direction of the rocker cam during opening of the engine valve.

8. The variable valve device as defined in claim 7, wherein, in the predetermined operating angle range, the distance between the center of the drive shaft and the center of the rocker shaft increases as the operating angle increases.

9. The variable valve device as defined in claim 8, wherein the predetermined operating angle range is from a predetermined operating angle between a minimum operating angle and a maximum operating angle to the maximum operating angle.

10. The variable valve device as defined in claim 8, wherein the predetermined operating angle range is from a minimum operating angle to a predetermined operating angle between the minimum operating angle and a maximum operating angle.

11. The variable valve device as defined in claim 5, wherein, when viewed from a front surface of the engine, a locus of the center of the rocker shaft approaches an equal lift line, which is a locus of the center of the rocker shaft on which the maximum lift is maintained at a constant, toward the maximum operating angle.

12. The variable valve device as defined in claim 5, wherein the distance between the center of the rocker shaft and the center of the drive shaft at the maximum operating angle is equal to or greater than the distance between the center of the rocker shaft and the center of the drive shaft at the minimum operating angle.

13. The variable valve device as defined in claim 5, wherein the rocker shaft is formed as a part of a control shaft having a rotation center in a different position to the center of the rocker shaft, and the distance between the center of the rocker shaft and the center of the drive shaft at the maximum operating angle is greater than a distance between the center of the control shaft and the center of the drive shaft.

14. The variable valve device as defined in claim 5, wherein the rocker shaft is formed as a part of a control shaft having a rotation center in a different position to the center of the rocker shaft, when viewed from a front surface of the engine, the rotation center of a control shaft is located on a straight line linking the center of the drive shaft and the center of the rocker shaft when the operating angle is close to a midpoint between the minimum operating angle and the maximum operating angle, and the center of the control shaft is located on the drive shaft side of a normal line of an equal lift line, the equal lift line is a locus of the center of the rocker shaft on which the maximum lift is maintained at a constant and passing through the center of the rocker shaft at the maximum operating angle, the normal line passing through the center of the rocker shaft at the maximum operating angle.

15. A variable valve device comprising:

a drive shaft configured to rotate in synchronization with a crankshaft of an engine;

a drive cam provided on the drive shaft;

a rocker cam pivotally supported on the drive shaft;

an engine valve configured to be driven to open and close by the rocker cam;

a rocker shaft disposed parallel to the drive shaft;

a rocker arm pivotally supported on the rocker shaft;

a first link that links the rocker arm and the drive cam;

a second link that links the rocker arm and the rocker cam; and a rocker shaft position modifying section configured to modify a position of the rocker shaft relative to the drive shaft to control an operating angle and a lift of the engine valve, wherein the rocker shaft position modifying section is configured to modify the position of the rocker shaft relative to the drive shaft such that, when an angular acceleration of the rocker cam in a direction for reducing the lift of the engine valve while the rocker cam pivotally oscillates on the drive shaft is defined as a negative angular acceleration, an absolute value of the negative angular acceleration at a predetermined operating angle that is smaller than a maximum operating angle is equal to or greater than an absolute value of the negative angular acceleration at the maximum operating angle.

16. A variable valve device comprising:

a drive shaft configured to rotate in synchronization with a crankshaft of an engine;

a drive cam provided on the drive shaft;

a rocker cam pivotally supported on the drive shaft;

an engine valve configured to be driven to open and close by the rocker cam;

a rocker shaft disposed parallel to the drive shaft;

a rocker arm pivotally supported on the rocker shaft;

a first link that links the rocker arm and the drive cam;

a second link that links the rocker arm and the rocker cam; and a rocker shaft position modifying section configured to modify a position of the rocker shaft relative to the drive shaft to control an operating angle and a lift of the engine valve, wherein the rocker shaft position modifying section is configured to modify the position of the rocker shaft relative to the drive shaft such that, when an angular acceleration of the rocker cam in a direction for reducing the lift of the engine valve while the rocker cam pivotally oscillates on the drive shaft is defined as a negative angular acceleration, an absolute value of the negative angular acceleration at a predetermined operating angle that is larger than a minimum operating angle is equal to or smaller than an absolute value of the negative angular acceleration at the minimum operating angle.

* * * * *